US008351802B2

(12) United States Patent
Sonoda et al.

(10) Patent No.: US 8,351,802 B2
(45) Date of Patent: Jan. 8, 2013

(54) IMAGE FORMING APPARATUS HAVING A REPLACEABLE PART

(75) Inventors: Masahiro Sonoda, Tokyo (JP); Yoichi Hayakawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 356 days.

(21) Appl. No.: 12/662,929

(22) Filed: May 12, 2010

(65) Prior Publication Data

US 2010/0290791 A1 Nov. 18, 2010

(30) Foreign Application Priority Data

May 13, 2009 (JP) ..... 2009-116515

(51) Int. Cl.
*G03G 15/00* (2006.01)

(52) U.S. Cl. ..... 399/12; 399/49

(58) Field of Classification Search ..... 399/8, 12, 399/13, 49, 60, 81, 301
See application file for complete search history.

(56) References Cited

U.S. PATENT DOCUMENTS

| | | | | |
|---|---|---|---|---|
| 6,285,835 | B1 * | 9/2001 | Guillemin et al. | 399/8 |
| 6,625,402 | B2 * | 9/2003 | Takemoto | 399/8 |
| 6,711,362 | B2 * | 3/2004 | Asakura | 399/12 |
| 7,174,110 | B2 * | 2/2007 | Soga et al. | 399/12 |
| 7,206,524 | B2 * | 4/2007 | Yokoe | 399/12 |
| 7,551,864 | B2 * | 6/2009 | Fujimori et al. | 399/49 X |
| 2005/0254837 | A1 * | 11/2005 | Takahashi | 399/12 |
| 2005/0254838 | A1 * | 11/2005 | Takahashi | 399/12 |
| 2007/0297815 | A1 * | 12/2007 | Takada | 399/12 |
| 2008/0118253 | A1 * | 5/2008 | Abe | 399/12 |
| 2008/0212984 | A1 * | 9/2008 | Sasaki | 399/24 |

FOREIGN PATENT DOCUMENTS

| | | | |
|---|---|---|---|
| JP | 2000-284581 | A | 10/2000 |
| JP | 2004-220048 | A | 8/2004 |
| JP | 2004-258281 | A | 9/2004 |
| JP | 2005-326729 | A | 11/2005 |
| JP | 2007-223211 | A | 9/2007 |
| JP | 2008-058741 | A | 3/2008 |

* cited by examiner

*Primary Examiner* — Sandra Brase
(74) *Attorney, Agent, or Firm* — Rabin & Berdo, P.C.

(57) ABSTRACT

An image forming apparatus is capable of performing a plurality of controlling operations. The image forming apparatus includes a detachable replaceable part having an information storing unit that stores predetermined information, an information reading unit that reads the predetermined information from the information storing unit, a determining unit that determines whether the replaceable part is a genuine part or not based on the predetermined information read by the information reading unit, a display unit capable of displaying the predetermined information, and a control unit that determines a controlling operation among the plurality of controlling operations based on a determination by the determining unit.

26 Claims, 16 Drawing Sheets

FIG. 6

| | |
|---|---|
| 0 | INFORMATION |
| 1 | INFORMATION |
| • • • • | • • • • |
| 5 | INFORMATION |
| 6 | CORPORATION NAME INFORMATION (Ex.Oki Data Corporation) |

ON-LINE
Oki Data Corporation

PRINTING
Oki Data Corporation

ON-LINE
CORRECTION NOT PERFORMED

PRINTING
CORRECTION NOT PERFORMED

IMAGE FORMING APPARATUS HAVING A REPLACEABLE PART

BACKGROUND OF THE INVENTION

The present invention relates to an image forming apparatus to which replaceable parts are detachably provided.

A conventional image forming apparatus such as a printer is configured to perform a correction operation of an image density (i.e., an image density correction operation) or the like, in order to maintain printing quality. The image density correction operation is performed by forming a special pattern (i.e., an image density detection pattern) on a feeding belt using a toner and by detecting an image density of the image density detection patter by mean of an image density detection unit (see, for example, Japanese Laid-Open Patent Publication No. 2004-258281).

The image forming apparatus includes a toner cartridge in which a toner is stored. The toner cartridge is a replaceable part which is detachable from a main body of the image forming apparatus. When the toner stored in the toner cartridge is used up, the toner cartridge is replaced with a new toner cartridge for replenishing the toner to the image forming apparatus. As a new toner cartridge, it is preferable to use a genuine part (i.e., a genuine toner cartridge) supplied by a manufacturer of the image forming apparatus, since the performance of the genuine toner cartridge is assured by the manufacturer of the image forming apparatus. However, as with other replaceable parts of the image forming apparatus, there are non-genuine toner cartridges supplied by other manufacturers. Therefore, there are cases where a user may inadvertently use a non-genuine toner cartridge.

SUMMARY OF THE INVENTION

The present invention is intended to provide an image forming apparatus enabling a user to recognize whether a replaceable part thereof is a genuine part or not in a simple manner, and capable of determining an operation based on whether the replaceable part is a genuine part or not.

The present invention provides an image forming apparatus capable of performing a plurality of controlling operations. The image forming apparatus includes a detachable replaceable part having an information storing unit that stores predetermined information, an information reading unit that reads the predetermined information from the information storing unit, a determining unit that determines whether the replaceable part is a genuine part or not, based on the predetermined information read by the information reading unit, a display unit that displays the predetermined information, a control unit that determines a controlling operation among the plurality of the controlling operations based on a determination by the determining unit.

With such a configuration, a user can easily recognize whether the replaceable part of the image forming apparatus is a genuine part or not, based on the predetermined information displayed by the display unit. Therefore, the user is encouraged to use a genuine part as the replaceable part. Furthermore, the controlling operation of the image forming apparatus can be determined based on whether the replaceable part mounted thereto is a genuine part or not.

Further scope of applicability of the present invention, will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIG. 6 is a schematic view showing an example of a memory structure of a nonvolatile memory of the memory tag according to the first embodiment of the present invention;

DETAILED DESCRIPTION OF THE PREFERRED EMBODIMENT

Hereinafter, embodiments of the present invention will be described with reference to drawings. The present invention is not limited to the embodiment described below, and modifications and improvements may be made to the invention without departing from the spirit and scope of the invention.

First Embodiment

Figure 1:
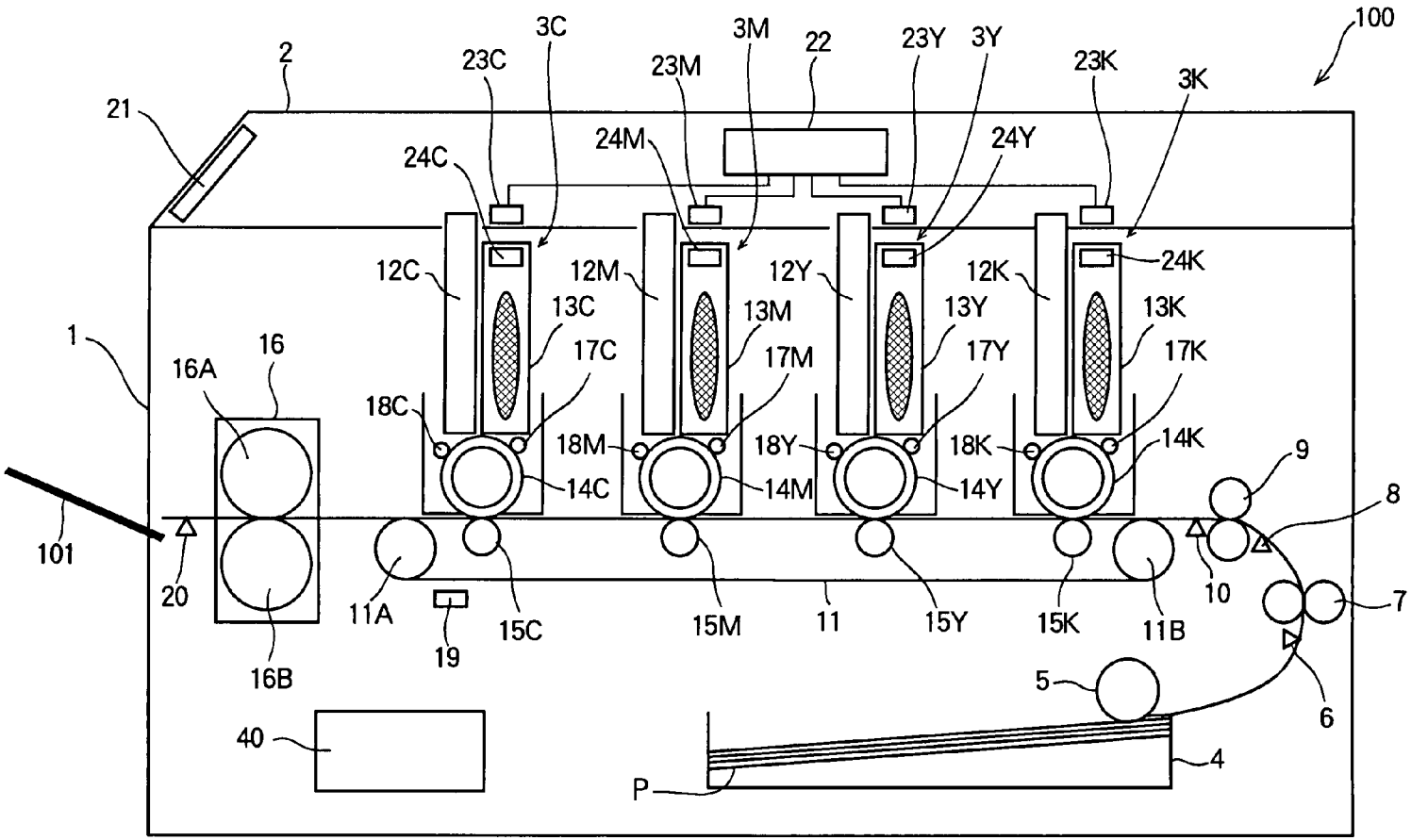
FIG. 1 is a schematic side view showing a configuration of a color printer as an image forming apparatus according to the first embodiment of the present invention.

FIG. 1 is a schematic side view showing a color printer 100 as an example of an image forming apparatus according to the first embodiment. The configuration of the color printer 100 will be described with reference to FIG. 1. The color printer 100 is of a tandem-type, and includes a main body 1 and a top cover 2 provided on the main body 1. The top cover 2 is swingable (i.e., openable and closable) with respect to the main body 1.

First, the main body 1 of the color printer 100 will be described.

The main body 1 of the color printer 100 includes image forming units 3K, 3Y, 3M and 3C of black (K), yellow (Y), magenta (M) and cyan (C) linearly arranged in this order from the left to the right in FIG. 1. A recording medium storing portion 4 is provided on a lower part of the main body 1. The recording medium storing portion 4 is able to store a plurality of recording media P such as papers (on which images are formed by the image forming units 3K, 3Y, 3M and 3C). A feeding roller 5 is provided on an upper side of the recording medium storing portion 4, and feeds the individual recording medium P out of the recording medium storing portion 4 into a medium feeding path. First and second registration rollers 7 and 9 are provided on a downstream side of the feeding roller 5, and feed the recording medium P (having been fed out of the recording medium storing portion 4 by the feeding roller 5) to the image forming units 3K, 3Y, 3M and 3C.

A first IN sensor 6 is provided on the upstream side of the first registration rollers 7, and detects that the recording medium P passes the position of the first IN sensor 6. A second IN sensor 8 is provided on the upstream side of the second registration rollers 9, and detects that the recording medium P passes the position of the IN sensor 8. A WR sensor 10 is provided on the downstream side of the second registration roller 9, and detects that the recording medium P passes the position of the WR sensor 10. A feeding belt 11 (i.e., a transfer belt) is provided so as to face the image forming units 3K, 3Y, 3M and 3C. The feeding belt 11 is stretched around a driving roller 11A and a tensioning roller 11B. As the driving roller 11A rotates, the feeding belt 11 moves and feeds the recording medium P passing through the image forming units 3K, 3Y, 3M and 3C.

Four LED heads 12K, 12Y, 12M and 12C (i.e., exposure units) are provided so as to face photosensitive drums 14K, 14Y, 14M and 14C (described later) of the image forming units 3K, 3Y, 3M and 3C. The LED heads 12K, 12Y, 12M and 12C irradiate surfaces of the photosensitive drums 14K, 14Y, 14M and 14C with light according to print data sent from a host computer (not shown). The LED heads 12K, 12Y, 12M and 12C are fixed to not shown holders provided on the top cover 2. When the top cover 2 is in a closing position as shown in FIG. 1, the LED heads 12K, 12Y, 12M and 12C face the photosensitive drums 14K, 14Y, 14M and 14C in mutual proximity, and are able to irradiate the surfaces of the photosensitive drums 14K, 14Y, 14M and 14C. The LED heads 12K, 12Y, 12M and 12C are connected to the main body 1 via cables.

The image forming units 3K, 3Y, 3M and 3C include toner cartridges 13K, 13Y, 13M and 13C (i.e., developer storing bodies) as replaceable parts in which toners (developers) of black, yellow, magenta and cyan are respectively stored. The toner cartridges 13K, 13Y, 13M and 13C are detachable from the main body 1, and therefore each of the toner cartridges can be replaced when the toner stored therein is used up. The toner cartridges 13K, 13Y, 13M and 13C have memory tags 24K, 24Y, 24M and 24C as information storing units which will be described later. Hereinafter, the toner cartridges 13K, 13Y, 13M and 13C are collectively referred to as the toner cartridge 13 as necessary. The memory tags 24K, 24Y, 24M and 24C are collectively referred to the memory tag 24 as necessary.

The image forming units 3K, 3Y, 3M and 3C include the photosensitive drums 14K, 14Y, 14M and 14C having surfaces on which electrostatic latent images are formed by electrostatic force. The image forming units 3K, 3Y, 3M and 3C further include charging rollers 18K, 18Y, 18M and 18C (i.e., charging units) that uniformly charge the surfaces of the photosensitive drums 14K, 14Y, 14M and 14C. The image forming units 3K, 3Y, 3M and 3C further include developing rollers 17K, 17Y, 17M and 17C that develop the latent images on the surfaces of the photosensitive drums 14K, 14Y, 14M and 14C using toners supplied by the toner cartridges 13K, 13Y, 13M and 13C. Transfer rollers 15K, 15Y, 15M and 15C (i.e., transfer units) are provided so as to face the photosensitive drums 14K, 14Y, 14M and 14C. The transfer rollers 15K, 15Y, 15M and 15C transfer the toner images from the photosensitive drums 14K, 14Y, 14M and 14C to the recording medium P. Further, a high voltage power source 40 is provided in the main body 1. The high voltage power source 40 applies high voltages to the photosensitive drums 14K, 14Y, 14M and 14C, the charging rollers 18K, 18Y, 18M and 18C, the developing rollers 17K, 17Y, 17M and 17C and the transfer rollers 15K, 15Y, 15M and 15C for electrophotographic process (i.e., charging, developing and transferring and the like). In this regard, the high voltage power source 40 corresponds to a power source for supplying electricity to the color printer 100.

A fixing unit 16 is disposed on the downstream side of the image forming units 3K, 3Y, 3M and 3C, and includes a heat roller 16A and a backup roller 16B both having heaters (such as halogen lamps) therein. The heat roller 16A and the backup roller 16B apply heat and pressure to the toner image on the recording medium P so as to fix the toner image to the recording medium P. An EXIT sensor 20 is provided on the downstream side of the fixing unit 16, and detects that the recording medium P is ejected out of the fixing unit 16. An ejection stacker 101 is provided on the outside of the main body 1 so as to receive the recording medium P ejected out of the fixing unit 16.

A density sensor 19 is provided on the lower side of the feeding belt 11 so as to face the surface of the feeding belt 11. The density sensor 19 is an optical sensor that reads an image density detection pattern formed on the surface of the feeding belt 11. The density sensor 19 is used in a printing-quality-maintenance operation, to be more specific, an image density correction operation. A detailed description of the density sensor 19 will be made later.

The respective feeding sensors 44 (i.e., the first IN sensor 6, the second IN sensor 8, the WR sensor 10 and the EXIT sensor 20) and the image density sensor 19 are connected to a control unit (i.e., a CPU 36 shown in FIG. 2) of the main body 1 via cables. The respective rollers (i.e., the feeding roller 5, the first registration roller 7, the second registration roller 9, the driving roller 11A, the photosensitive drum 14K, 14Y, 14M and 14C, the transfer roller 15K, 15Y, 15M and 15C and the fixing roller 16A) are driven by actuators 45 (FIG. 4) so as to feed the recording medium P from the upstream to the downstream along the medium feeding path.

Next, the top cover 2 will be described. The top cover 2 includes a display unit 21 having an LCD (liquid crystal display) panel, switches and the like. The display unit 21 is connected to a control unit (i.e., the CPU 36 of FIG. 2) of the main body 1. The display unit 21 displays a status of the color printer 100 and provides a user-interface for receiving user input. The LCD panel is able to display, for example, total 48 characters in two rows (upper and lower rows), i.e., 24 characters in each row.

The main body 1 includes an information reading unit 22 and transmission/receiving antennas 23K, 23Y, 23M and 23C (collectively referred to as the transmission/receiving antenna 23) for reading information from the memory tags 24K, 24Y, 24M and 24C of the toner cartridges 13K, 13Y, 13M and 13C.

Figure 2:
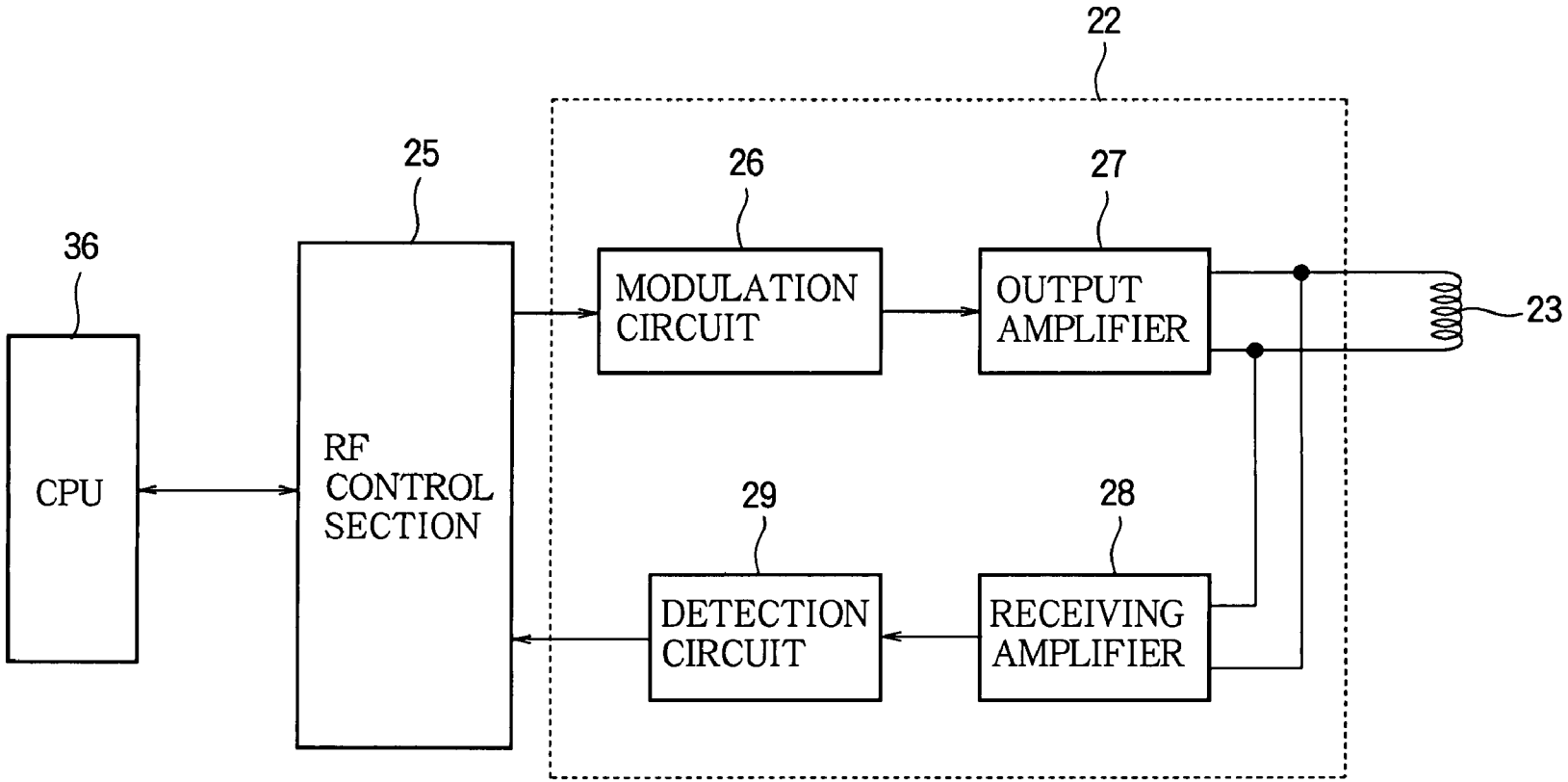
FIG. 2 is a block diagram showing a configuration of an information reading unit according to the first embodiment of the present invention.

A configuration of the information reading unit 22 of the main body 1 will be described. FIG. 2 is a block diagram showing the configuration of the information reading unit 22. The information reading unit 22 includes an RF control section 25, a modulation circuit 26, an output amplifier 27, a receiving amplifier 28, and a detection circuit 29. The information reading unit 22 is connected to the transmitting/receiving antenna 23 via cables. The information reading unit 22 receives a control signal and electric power from the main body 1 via cables. The RF control section 25 controls input from the CPU 36 and output to the CPU 36. Further, the RF control section 25 controls communication with the memory tag 24 of each of the toner cartridges 13K, 13Y, 13M and 13C so as to read information from the memory tag 24 and to write information on the memory tag 24. The CPU 36 corresponds to the control unit of the main body 1.

The modulation circuit 26 performs ASK-modulation in which the modulation data is modulated with a carrier wave of a different wavelength. The modulation circuit 26 then outputs the ASK-modulated signal to the output amplifier 27. The output amplifier 27 amplifies the ASK-modulated signal, and outputs the amplified ASK-modulated signal to the transmitting/receiving antenna 23. The transmitting/receiving antenna 23 transmits the amplified ASK-modulated signal to the memory tag 24. Further, the transmitting/receiving antenna 23 receives signal transmitted from the memory tag 24, and outputs the received signal to the receiving amplifier 28. The receiving amplifier 28 amplifies the received signal, and outputs the amplified signal to the detection circuit 29. The detection circuit 29 demodulates the received signal into a binary signal, and outputs the binary signal to the RF control section 25.

Next, the memory tag 24 of each toner cartridge 13 will be described.

Figure 3:
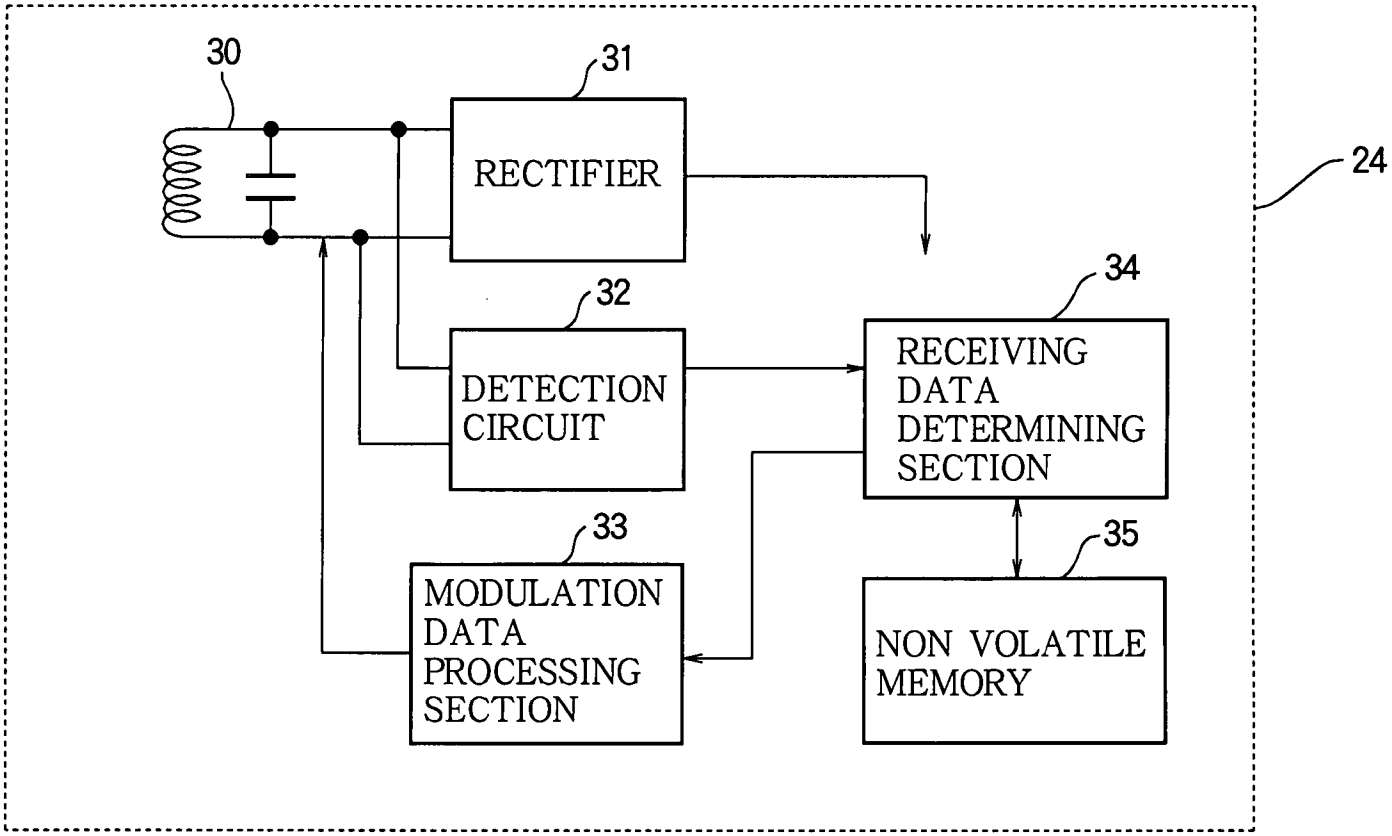
FIG. 3 is a block diagram showing a configuration of a memory tag according to the first embodiment of the present invention.

FIG. 3 is a block diagram showing a configuration of the memory tag 24. The memory tag 24 includes a transmitting/receiving antenna 30, a rectifier 31, a detection circuit 32, a modulation data producing section 33, a receiving data determining section 34 and a nonvolatile memory 35.

The transmitting/receiving antenna 30 receives the ASK-modulated signal transmitted by the information reading unit 22. The rectifier 31 rectifies an alternating magnetic field received by the transmitting/receiving antenna 30, and produced electric power for the memory tag 24. The detection circuit 32 demodulates the ASK-modulated signal (received by the transmitting/receiving antenna 30) into a binary signal, and outputs the binary signal to the receiving data determining section 34. The receiving data determining section 34 extracts the signal demodulated by the detection circuit 32, decodes instructions contained in the demodulated signal, and detects a carrier signal. The receiving data determining section 34 outputs a response (responding to the instruction) and a carrier detection signal to the modulation data producing section 33. If the decoded result of the data instruction indicates a reading/writing operation of memory data, the receiving data determining section 34 accesses the nonvolatile memory 35, and performs the reading/writing operation in which data is read from or written on the nonvolatile memory 35.

Next, the control system of the color printer 100 will be described.

Figure 4:
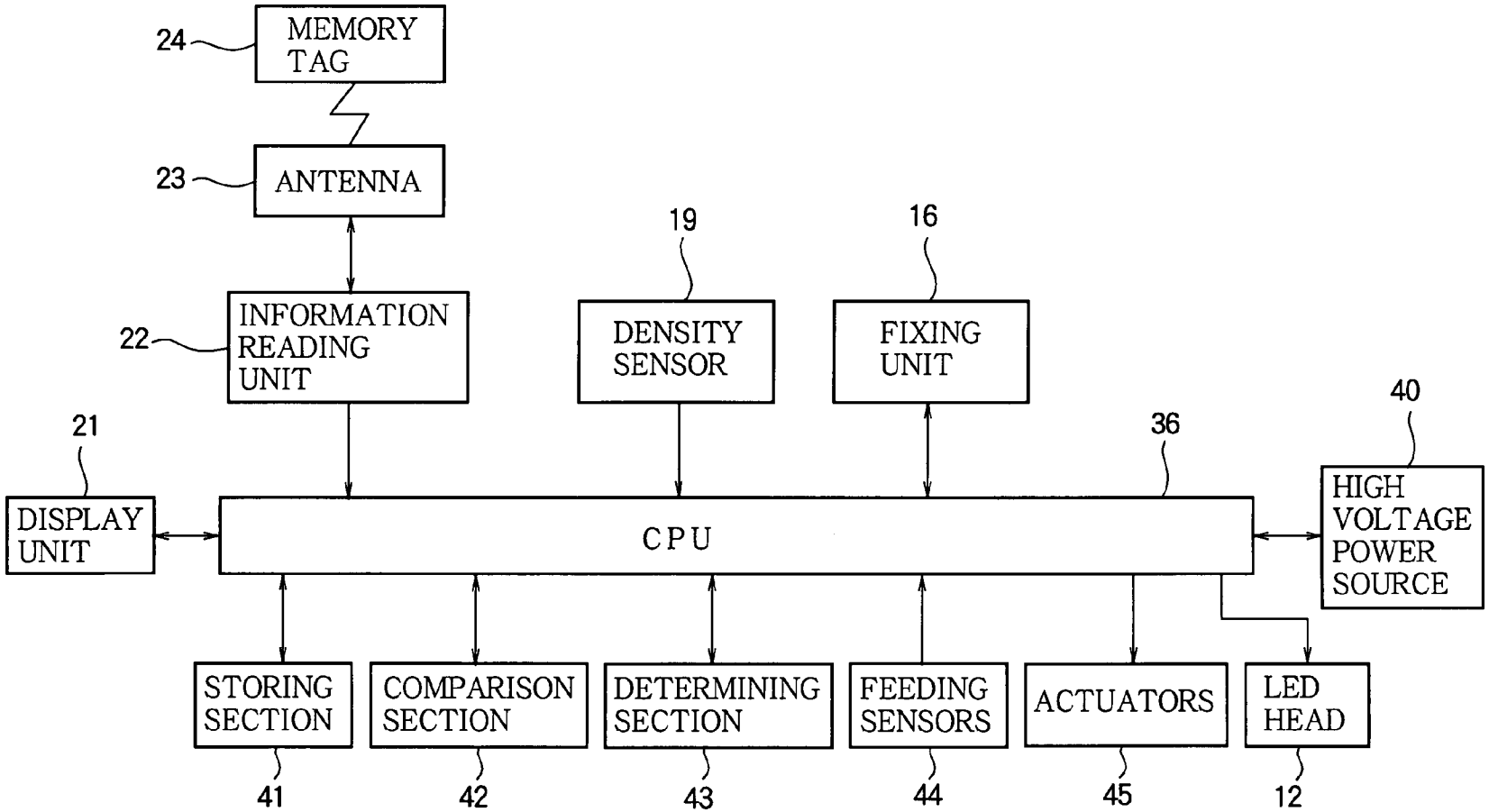
FIG. 4 is a block diagram showing a control system according to the first embodiment of the present invention.

FIG. 4 is a block diagram showing the control system of the color printer 100.

The CPU 36 performs various operations according to programs for controlling the color printer 100. The CPU 36 is connected to the density sensor 19, the high voltage power source 40, the display unit 21, the information reading unit 22, a storing section 41, a comparison section 42 (i.e., a comparison unit), a determination section 43, the feeding sensors 44 (i.e., the first IN sensor 6, the second IN sensor 8, the WR sensor 10 and the EXIT sensor 20) and the actuators 45 via input/output ports. The density sensor 19, the high voltage power source 40, the display unit 21, the information reading unit 22, the storing section 41, the comparison section 42, the determination section 43, the feeding sensors 44 and the actuators 45 supply data to the CPU 36, and are controlled by the CPU 36.

The storing section 41 is composed of a nonvolatile memory such as an EEPROM. The storing section 41 stores predetermined information required for determining whether the toner cartridge 13 is a genuine part or not. In this embodiment, the information read from the nonvolatile memory 35 of the memory tag 24 of the toner cartridge 13 (mounted to the main body 1) is matched to the information stored in the storing section 41, so as to determine whether the toner cartridge 13 is a genuine part or not. The comparison section 42 compares the information read from the nonvolatile memory 35 of the memory tag 24 and the information stored in the storing section 41. The determining section 43 (i.e., a determining unit) determines whether the toner cartridge 13 is a genuine part or not based on a result of the comparison by the comparison section 42.

The CPU 36 and the like (for example, the storing section 41, the comparison section 42 and the determining section 43) correspond to the control unit that controls entire operation of the color printer 100, and are therefore hereinafter referred to as the control unit 36.

Next, an image forming operation (i.e., a printing operation) of the color printer 100 will be described with reference to FIGS. 1 and 4.

When the control unit 36 of the color printer 100 receives a printing instruction from a host computer such as a personal computer, the control unit 36 performs a printing operation corresponding to the printing instruction according to the control program incorporated in the control unit 36. The control unit 36 controls the actuators 45 such as motors to drive the feeding roller 5, the first registration rollers 7 and the second registration rollers 9 so as to feed the recording medium P from the recording medium storing portion 4 toward the image forming units 3K, 3Y, 3M and 3C.

The control unit 36 determines respective timings for driving the feeding roller 5, the first registration rollers 7 and the second registration rollers 9 based on a position of the recording medium P detected by the first IN sensor 6, the second IN sensor 8, the WR sensor 10 and the like (i.e., the feeding sensors).

When the WR sensor detects the leading edge of the recording medium P, the control unit 36 starts a printing process.

The control unit 36 controls the high voltage power source 40 to apply a charging voltage to the charging rollers 18K, 18Y, 18M and 18C so as to uniformly charge the surfaces of the photosensitive drums 14K, 14Y, 14M and 14C.

The control unit 36 controls the LED heads 12K, 12Y, 12M and 12C to irradiate the surfaces of the photosensitive drums 14K, 14Y, 14M and 14C according to the printing instruction (i.e., printing data) sent from the host computer, so that latent images (corresponding to the printing data) are formed on the surfaces of the photosensitive drums 14K, 14Y, 14M and 14C. In this regard, the photosensitive drums 14K, 14Y, 14M and 14C and the transfer rollers 15K, 15Y, 15M and 15C are rotated by the actuators 45 (controlled by the control unit 36) in directions to feed the recording medium P to the downstream side in the main body 1.

The developing rollers 17K, 17Y, 17M and 17C are applied with a developing voltage by the high voltage power source 40 under control of the control unit 36, and develop the latent images on the surfaces of the photosensitive drums 14K, 14Y, 14M and 14C by causing the toner to adhere to the latent images by means of electric force, with the result that toner images are formed on the surfaces of the photosensitive drums 14K, 14Y, 14M and 14C.

The transfer rollers 15K, 15Y, 15M and 15C are applied with a transfer voltage by the high voltage power source 40 under control of the control unit 36, and transfer the toner images from the surfaces of the photosensitive drums 14K, 14Y, 14M and 14C to the surfaces of the recording medium P. With such a process, a color image is formed on the surface of the recording medium P in the case where the printing data is a color image data. Then, the recording medium P is fed to the fixing unit 16 including the heat roller 16A and the backup roller 16B provided with heaters (such as halogen lamps). The control unit 36 controls the fixing unit 16 according to a fixing temperature detected by a temperature detecting element such as a thermistor so that the toner image is fixed to the surface of the recording medium P at a suitable temperature. Then, the recording medium P on which the toner image is fixed is ejected to the ejection stacker 101 on the outside of the main body 1 passing through the EXIT sensor 20.

Figure 5:
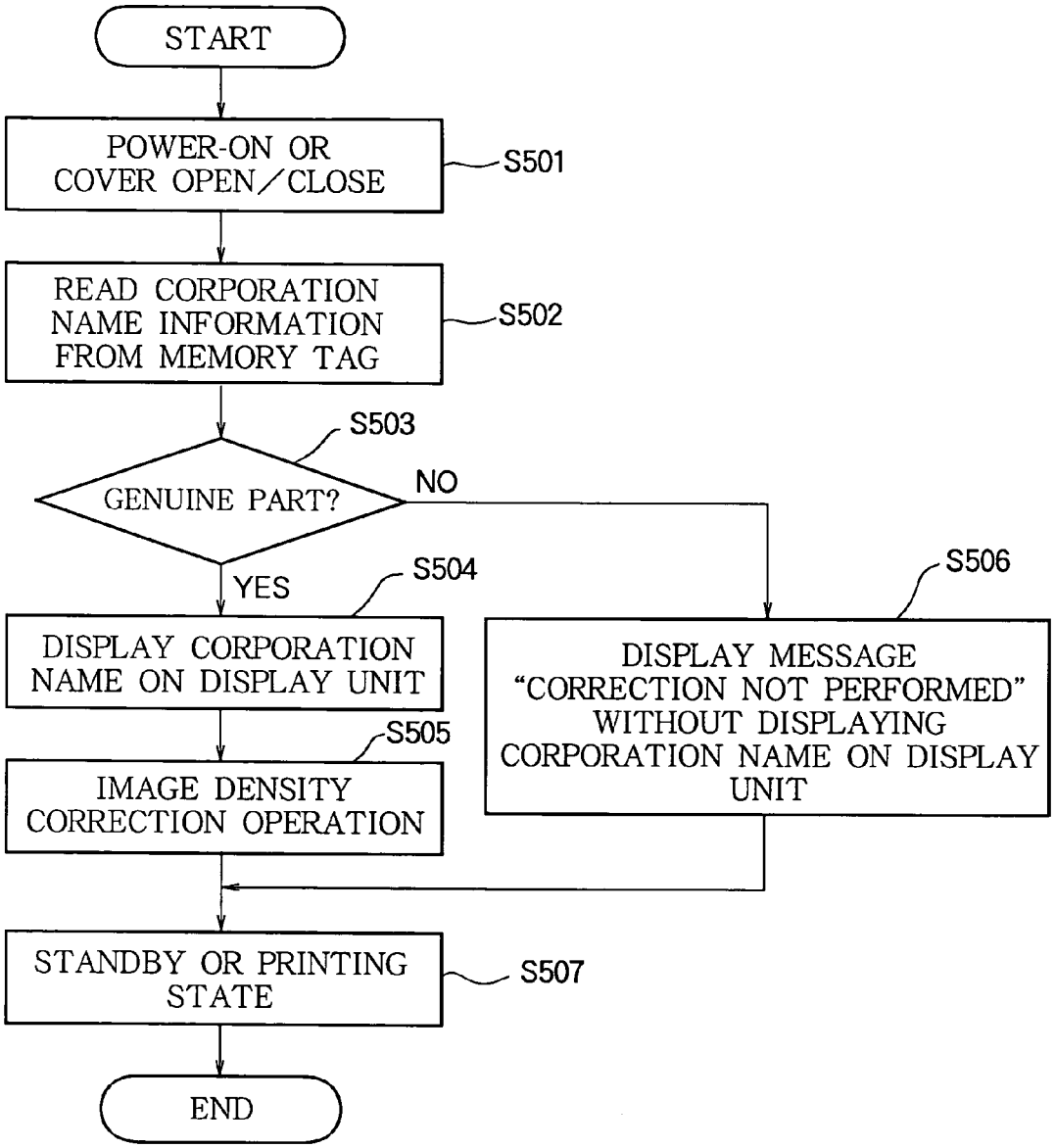
FIG. 5 is a flow chart showing a process according to the first embodiment of the present invention.

FIG. 5 is a flow chart showing a process according to the first embodiment of the present invention.

In a step S501, the control unit 36 detects the power-ON of the color printer 100 or the opening/closing of the top cover 2. In this regard, when the power of the color printer 100 is turned ON or when the top cover 2 is opened/closed, it indicates a possibility that the toner cartridge 13 is mounted to the main body 1 or the toner cartridge 13 is replaced.

In a step S502, the control unit 36 controls the information reading unit 22 to perform RF communication with the memory tags 24K, 24Y, 24M and 24C of the toner cartridges 13K, 13Y, 13M and 13C, and to read predetermined information from the nonvolatile memories 35 of the memory tags 24K, 24Y, 24M and 24C. Each nonvolatile memory 35 stores information of a name of a manufacturer of the toner cartridge (hereinafter, referred to as corporation name information) as the predetermined information.

Next, a process in which the information reading unit 22 of the main body 1 reads the corporation name information from the nonvolatile memory 35 of each memory tag 24 will be described with reference to FIGS. 2 and 3.

Upon receiving a command (i.e., a control signal) from the control unit 36 via a connection cable, the RF control section 25 of the information reading unit 22 analyzes the command to produce a binary signal data. The RF control section 25 then outputs the binary data to the modulation circuit 26. The modulation circuit 26 performs ASK modulation in which two waveforms with different amplitudes are combined, and outputs the ASK-modulated signal to the output amplifier 27. The output amplifier 27 amplifies the ASK-modulated signal, and outputs the amplified ASK-modulated signal to the transmitting/receiving antenna 23. The transmitting/receiving antenna transmits the ASK-modulated signal via radio waves. The ASK-modulated signal transmitted by the transmitting/receiving antenna 23 is received by the transmitting/receiving antenna 30 of the memory tag 24. Upon receiving the radio waves, an induction voltage is induced at both ends of the transmitting/receiving antenna 30, and is rectified by the rectifier 31, so that the memory tag 24 is supplied with electric power. The detecting circuit 32 demodulates the received ASK-modulated signal into a binary signal, and outputs the binary signal to the receiving data determining section 34. The receiving data determining section 34 extracts the signal demodulated by the detection circuit 32, decodes instructions contained in the demodulated signal, and detects the carrier signal. The receiving data determining section 34 then outputs the response (responding to the instruction) and the carrier detection signal to the modulation data producing section 33. Further, the receiving data determining section 34 accesses the nonvolatile memory 35, and reads the corporation name information stored in the nonvolatile memory 35.

FIG. 6 is a schematic view showing an example of a memory area structure of the nonvolatile memory 35. As shown in FIG. 6, the nonvolatile memory 35 stores predetermined information at each address. In the example shown in FIG. 6, the corporation name information is stored at address "6" of the nonvolatile memory 35. The information stored in the nonvolatile memory 35 is read according to the decoded result by the receiving data determining section 34. In this regard, the corporation name information (i.e., the name of a manufacturer of the toner cartridge 13) is digitalized using ASCII code. The information read by the nonvolatile memory 35 is modulated by the modulation data producing section 33, and is transmitted by the transmitting/receiving antenna 30 to the information reading unit 22. The corporation name information transmitted by the memory tag 24 is received by the transmitting/receiving antenna 23 of the information reading unit 22, is amplified by the receiving amplifier section 28, and is demodulated by the detection circuit 29 into a binary signal. The RF control section 25 outputs the demodulated binary signal to the control unit 36.

Referring back to FIG. 5, in a step S503, the control unit 36 determines whether each of the toner cartridges 13K, 13Y, 13M and 13C mounted to the main body 1 is a genuine part or not, based on the corporation name information read from the nonvolatile memory 35 of each memory tag 24 (in the above described step S502). If the control unit 36 determines that all of the toner cartridges 13K, 13Y, 13M and 13C mounted to the main body 1 are genuine parts (YES in the step S503), the control unit 36 proceeds to a step S504. If the control unit 36 determines that at least one of the toner cartridges 13K, 13Y, 13M and 13C mounted to the main body 1 is a non-genuine part (NO in the step S503), the control unit 36 proceeds to a step S506.

A detailed description of the step S503 is given herein with reference to FIGS. 3 and 4. The CPU 36 (constituting the control unit 36 as described above) outputs to the comparison section 42 the corporation name information read from the nonvolatile memory 35 of the memory tag 24 and the corporation name information preliminarily stored in the storing section 41 of the main body 1. The comparison section 42 compares the corporation name information read from the memory tag 24 and the corporation name information stored in the storing section 41. The comparison result by the comparison section 42 is outputted to the determining section 43. If the corporation name information read from the memory tag 24 is the same as the corporation name information stored in the storing section 41, the determining section 43 determines that the toner cartridge 13 is a genuine part. If the corporation name information read from the memory tag 24 is different from the corporation name information stored in the storing section 41, the determining section 43 determines that the toner cartridge 13 is a non-genuine part.

For example, if the corporation name information stored in the storing section 37 of the main body 1 is "Oki Data Corporation", and if the corporation name information read from the memory tags 24 of the toner cartridges 13K, 13Y, 13M and 13C is "Oki Data Corporation", the determining section 43 determines that the toner cartridges 13K, 13Y, 13M and 13C are all genuine parts. In contrast, if the corporation name information read from the memory tag 24 of any of the toner cartridges 13K, 13Y, 13M and 13C is not "Oki Data Corporation", the determining section 43 determines that the toner cartridge 13 is a non-genuine part. Further, when the corporation name information can not be read from any of the toner cartridges 13K, 13Y, 13M and 13C, the determining section 43 determines that the toner cartridge 13 is a non-genuine part.

Referring back to FIG. 5, in the step S504 (i.e., the toner cartridges 13K, 13Y, 13M and 13C are determined to be genuine parts in the step S503), the control unit 36 causes the display unit 21 to display the corporation name information.

Figures 7, 8A, 8B, 8C, 8D:
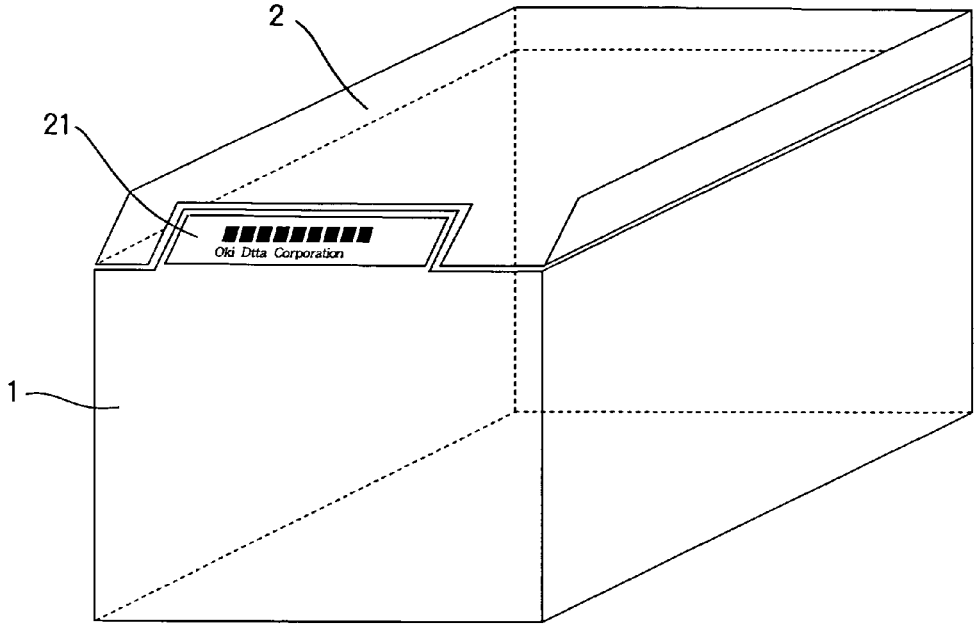
FIG. 7 is a schematic perspective view showing the color printer when a display unit thereof displays corporation name information.
FIGS. 8A, 8B, 8C and 8D show examples of characters displayed on the display unit according to the first embodiment of the present invention.

FIG. 7 shows an example of the color printer 100 with the display unit 21 displaying the corporation name information.

As shown in FIG. 7, the display unit 21 has the LCD panel capable of displaying, for example, total 48 characters in two rows (upper and lower rows), i.e., 24 characters in each rows.

FIGS. 8A, 8B, 8C and 8D show examples of characters displayed on the display unit 21.

As shown in FIGS. 8A and 8B, the toner cartridges 13K, 13Y, 13M and 13C are determined to be genuine parts, the control unit 36 causes the display unit 21 to display a status of the color printer 100 such as "ON-LINE" (FIG. 8A) or "PRINTING" (FIG. 8B) at the upper row, and to display the corporation name information such as "Oki Data Corporation" at the lower row.

As shown in FIGS. 8C and 8D, if at least one of the toner cartridges 13K, 13Y, 13M and 13C is determined to be a non-genuine part, the control unit 36 causes the display unit 21 to display a status of the color printer 100 such as "ON-LINE" (FIG. 8C) or "PRINTING" (FIG. 8D) at the upper row, and to display a message indicating that an image density correction operation is not performed (for example, "CORRECTION NOT PERFORMED") at the lower row.

Referring back to FIG. 5, in a step S505 (i.e., the toner cartridges 13K, 13Y, 13M and 13C are determined to be genuine parts in the step S503), the control unit 36 performs the image density correction operation (i.e., a printing-quality-maintenance operation) in order to prevent degradation of printing quality due to time-dependent changes, environmental changes and the like. This printing-quality-maintenance operation is performed, for example, after the power of the color printer 100 is turned ON or after the printing on the predetermined pages (for example, 500 pages) have been completed. A detailed description of the image density correction operation will be made later.

In the step S506 (i.e., at least one of the toner cartridges 13K, 13Y, 13M and 13C is determined to be a non-genuine part in the step S503), the control unit 36 causes the display unit 21 to display a message indicating that the image density correction operation is not performed (for example, "CORRECTION NOT PERFORMED") at the lower row as shown in FIGS. 8C and 8D without displaying the corporation name information, and proceeds to a step S507.

Here, a description will be made of a reason why the image density correction operation is not performed in the case where at least one of the toner cartridges 13K, 13Y, 13M and 13C is a non-genuine part.

Generally, a genuine toner cartridge (i.e., a genuine part) is designed to correspond sufficiently with the printing-quality-maintenance operation so as to maintain the printing quality over time-depending changes, environmental changes and the like. In contrast, a non-genuine toner cartridge (i.e., a non-genuine part) is not designed to correspond with the printing-quality-maintenance operation. Therefore, if the printing-quality-maintenance operation is performed in a state where the non-genuine toner cartridge is mounted to the main body 1, there may be undesirable effect on printing quality or the color printer 100. For this reason, it is preferable not to perform the printing-quality-maintenance operation (such as the image density correction operation) in the case where at least one of the toner cartridges 13K, 13Y, 13M and 13C mounted to the main body 1 is a non-genuine part.

In the step S507, the color printer 100 is in a standby state (i.e., a state waiting for printing data) or in a printing state (i.e., a state having received the printing data).

Here, the image density correction operation (step S505) will be described in detail. In the image density correction operation, the control unit 36 performs the following steps.

In the image density correction operation, the control unit 36 controls the color printer 100 to form a special pattern for image density detection (referred to as an image density detection pattern) on the surface of the feeding belt 11.

Figure 9:
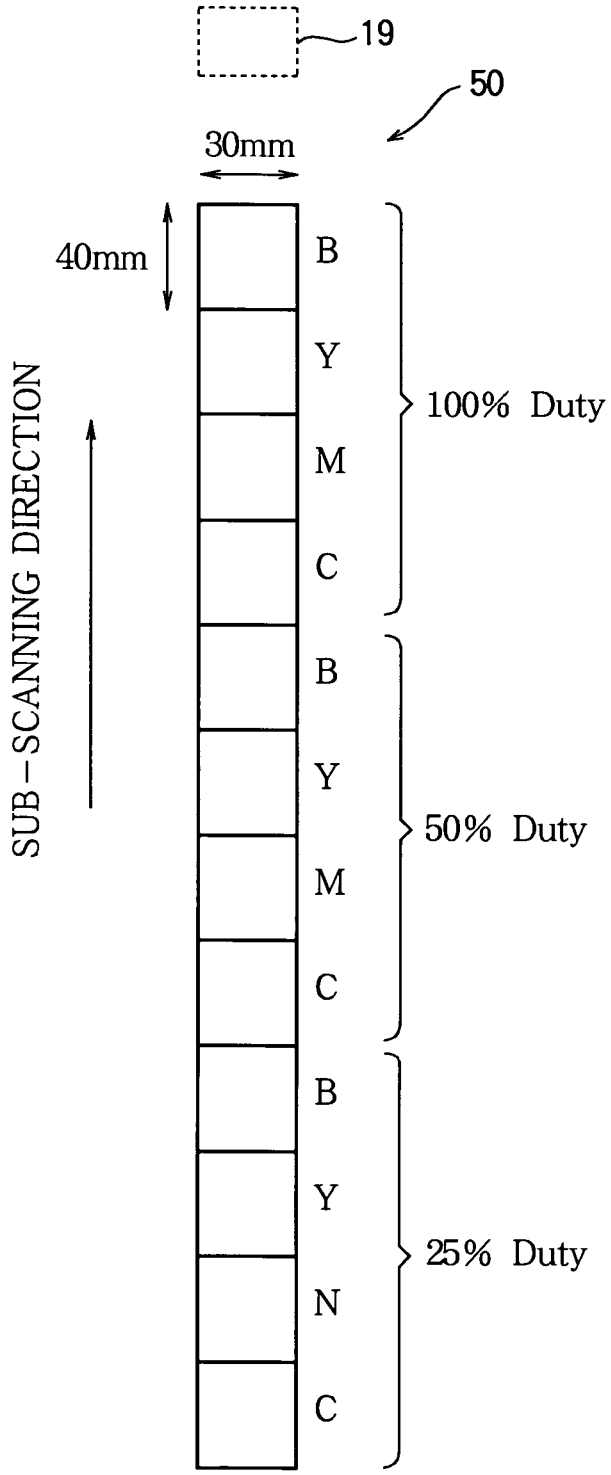
FIG. 9 is a schematic view showing an example of an image density detection pattern formed on a surface of a feeding belt according to the first embodiment of the present invention.

FIG. 9 shows an example of the image density detection pattern. As shown in FIG. 9, the image density detection pattern 50 includes 100% duty pattern, 50% duty pattern and 25% duty pattern which are continuously formed in a sub-scanning direction (i.e., perpendicular to the axial direction of the photosensitive drums 14K, 14Y, 14M and 14C). Each of the 100% duty pattern, the 50% duty pattern and the 25% duty pattern includes Black (K), Yellow (Y), Magenta (M) and Cyan (C) portion each of which has a size of 40 mm long and 30 mm wide.

Figure 10:
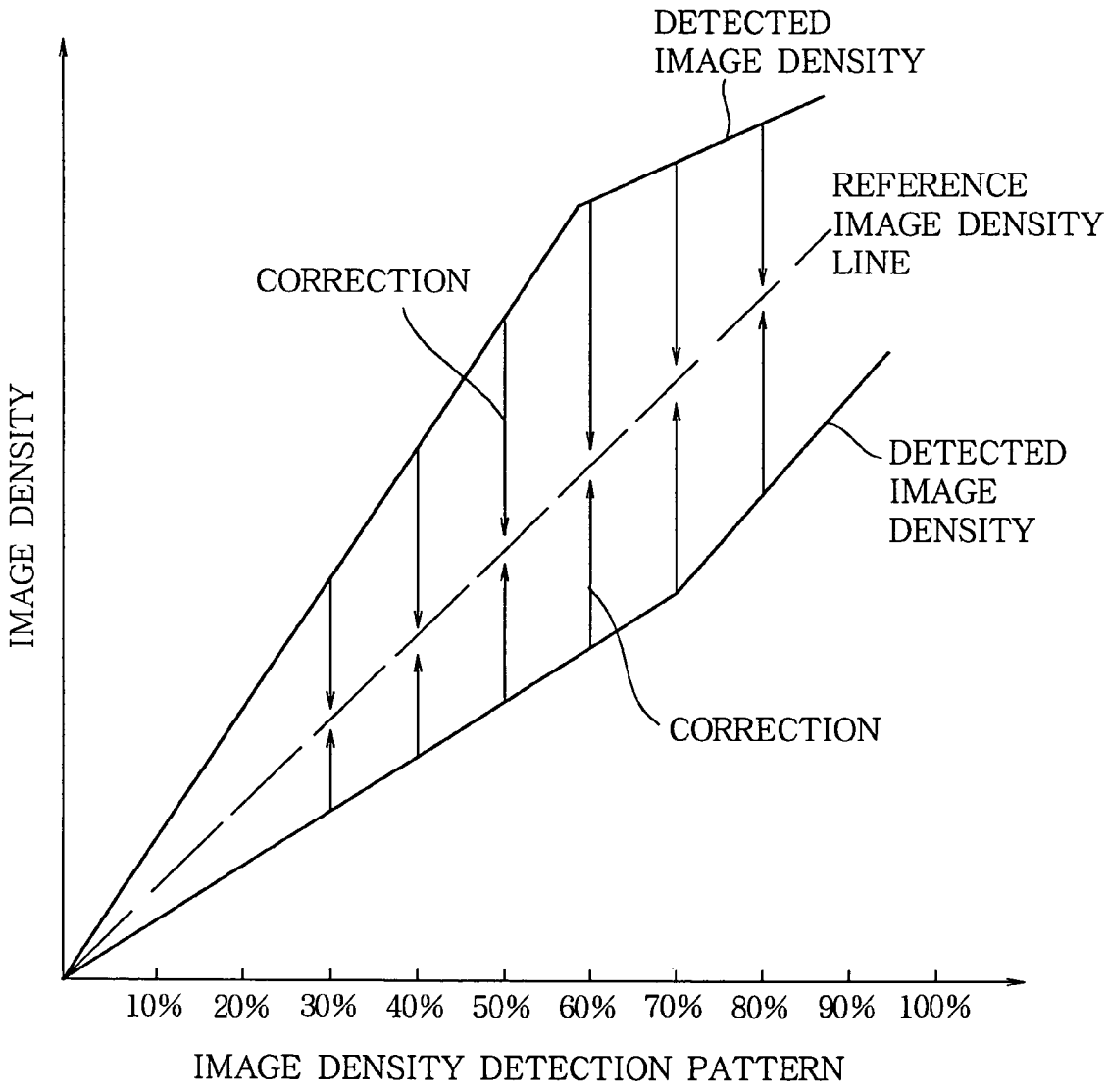
FIG. 10 is a schematic view schematically showing an image density correction operation according to the first embodiment of the present invention.

The density sensor 19 (shown by dashed line in FIG. 9) reads the image density detection pattern 50, and detects an image density of the image density detection pattern 50. This process is referred to as an image density detection process. The control unit 36 adjusts the developing voltage applied to the developing rollers 17K, 17Y, 17M and 17C and the light emission amount of the LED heads 12K, 12Y, 12M and 12C, so as to bring the image density detected by the density sensor 19 (i.e., the detected image density of the image density detection pattern 50) closer to a reference image density line as shown in FIG. 10 which is preliminarily stored in the control unit 36. To be more specific, if the detected image density is lower (i.e., thinner) than a corresponding reference image density on the reference image density line, the control unit 36 adjusts the developing voltage and the light emission amount so as to increase the image density. In contrast, if the detected image density is higher (i.e., denser) than the corresponding reference image density on the reference image density line, the control unit 36 adjusts the developing voltage and the light emission amount so as to reduce the image density. In other words, the control unit 36 performs the image density correction operation to thereby bring the detected image density closer to the corresponding reference image density on the reference image density line by increasing or reducing the image density. A correction amount can be finely set within a range between predetermined upper and lower limits. The image density detection pattern 50 formed on the surface of the feeding belt 11 is erased by a not shown toner removing mechanism (provided for removing the toner from the surface of the feeding belt 11) after passing the density sensor 19.

Figure 11:
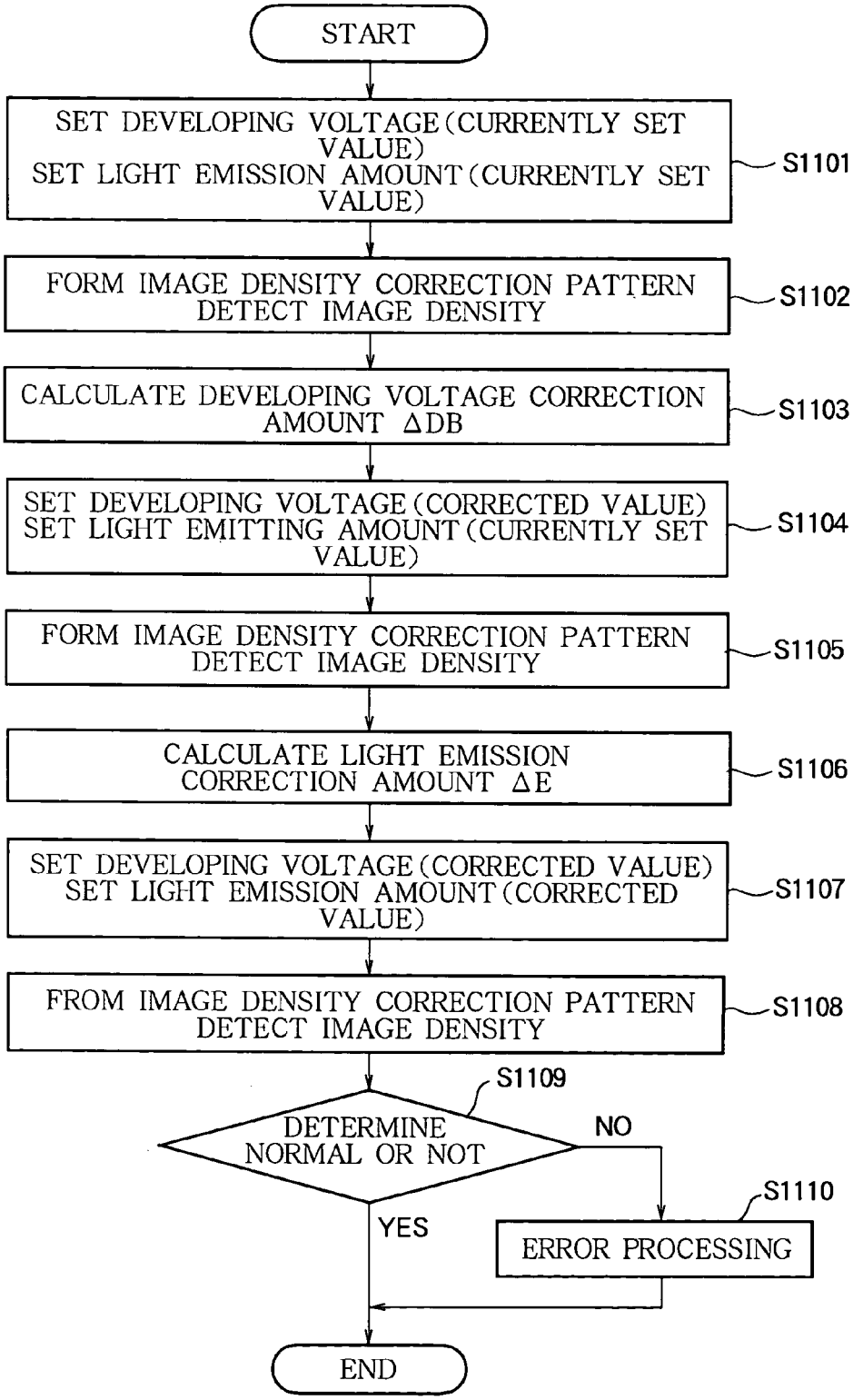
FIG. 11 is a flow chart showing the image density correction operation according to the first embodiment of the present invention.

FIG. 11 is a flow chart showing the image density correction operation.

In a step S1101, the control unit 36 sets the developing voltage (applied to the developing rollers 17K, 17Y, 17M and 17C) to a currently set voltage, and sets the light emission amount of the LED heads 12K, 12Y, 12M and 12C to a currently set light emission amount.

Next, in a step S1102, the control unit 36 controls the color printer 100 so as to form the image density detection pattern 50 of FIG. 9 on the surface of the feeding belt 11 while applying the developing voltage (having been set in the step S1101) to the developing rollers 17K, 17Y, 17M and 17C and driving the LED heads 12K, 12Y, 12M and 12C to emit lights at the light emission amount (having been set in the step S1101). Further, the control unit 36 performs the image density detection process to detect the image density of the image density detection pattern 50 using the density sensor 19. The detected image density provides an image density detection result.

Then, in a step S1103, the control unit 36 calculates a correction amount ΔDB of the developing voltage (i.e., a developing voltage correction amount ΔDB) based on the image density detection result in order to bring the image density closer to the reference image density. For example, the developing voltage correction amount ΔDB is determined based on detected image densities Ds100, Ds50 and Ds25 of the 100% duty pattern, the 50% duty pattern and the 25% duty pattern of the density detection pattern 50 (FIG. 9) detected by the density sensor 19 and reference image densities Dt100, Dt50 and Dt25 for the 100% duty pattern, the 50% duty pattern and the 25% duty pattern. The developing voltage correction amount ΔDB is determined using the following equation:

$$\Delta DB = DA \times \{a \times (Ds100 - Dt100) + b \times (Ds50 - Dt50) + c \times (Ds25 - Dt25)\}/(a+b+c)$$

In the above described equation, a, b and c are weighting coefficients for calculating an average image density error based on the respective image density errors. The weighting coefficients a, b and c are set according to standard changing amounts of the image densities with respect to the change of the developing voltage (which are preliminarily measured). DA is a unit adjustment factor for adjusting the above described average image density error to the reference image density.

In a step S1104, the control unit 36 corrects the developing voltage according to the correction amount ΔDB determined. To be more specific, the developing voltage applied to the developing rollers 17K, 17Y, 17M and 17C is set to "the currently set developing voltage+ΔDB". In this step S1104, the control unit 36 does not correct the light emission amount of the LED heads 12K, 12Y, 12M and 12C. In other words, the light emission amount of the LED heads 12K, 12Y, 12M and 12C is the same as currently set.

Then, in a step S1105, the control unit 36 controls the color printer 100 so as to form the density detection pattern 50 of FIG. 9 on the surface of the feeding belt 11, and performs the image density detection process using the density sensor 19.

In a step S1106, the control unit 36 calculates a correction amount ΔE of the light emission amount (i.e., a light emission correction amount ΔE) of the LED heads 12K, 12Y, 12M and 12C based on the image density detection result. For example, the light emission correction amount ΔE is determined based on detected image densities Ds100', Ds50' and Ds25' of the 100% duty pattern, the 50% duty pattern and the 25% duty pattern of the density detection pattern 50 (FIG. 9) detected in the step S1105 and the reference image densities Dt100, Dt50 and Dt25. The light emission correction amount ΔE is determined using the following equation:

$$\Delta E = DE \times \{a' \times (Ds100' - Dt100) + b' \times (Ds50' - Dt50) + c' \times (Ds25' - Dt25)\}/(a'+b'+c')$$

In the above described equation, a', b' and c' are weighting coefficients for calculating the average image density error based on the respective image density errors. The weighting coefficients a', b' and c' are set according to standard changing amounts of the image densities with respect to the change of the developing voltage (which are preliminarily measured). DE is a unit adjustment factor of the light emission amount of the LED heads 12K, 12Y, 12M and 12C for adjusting the above average image density error to the reference image density.

In a step S1107, the control unit 36 calculates the light emission amount based on the light emission correction amount ΔE (calculated in the step S1106). To be more specific, the light emission amount of the LED head 12K, 12Y, 12M and 12C is set to "the currently set light emission amount+ΔE".

In a step S1108, the control unit 36 controls the color printer 100 so as to form the density detection pattern 50 shown in FIG. 9 on the surface of the feeding belt 11 while applying the corrected developing voltage to the developing rollers 17K, 17Y, 17M and 17C and driving the LED heads 12K, 12Y, 12M and 12C to emit lights at the corrected light emission amount. Further, the control unit 36 performs the image density detection process using the detection sensor 19.

In a step S1109, the control unit 36 determines whether the image density detected by the density sensor 19 is in a normal range which is set close to the reference image density. If the control unit 36 determines that the detected image density is in the normal range (YES in step S1109), the control unit 36 ends the image density correction operation.

If the control unit 36 determines that the detected image density is not in the normal range (NO in step S1109), the control unit 36 performs an error processing in a step S1110. To be more specific, the control unit 36 changes the corrected developing voltage and the corrected light emission amount back to those before the image density correction operation, and causes the display unit 21 to display a message informing a user that the image density correction operation has not been normally performed. Then, the control unit 36 ends the image density correction operation.

Advantages of the first embodiment of the present invention will be described herein.

Generally, genuine toner cartridges provide printing quality which is assured by a manufacturer of the image forming apparatus (such as the color printer), and therefore it is preferable to use the genuine toner cartridges. However, since it is difficult for a user to distinguish genuine toner cartridges from non-genuine toner cartridges, there is a possibility that the user may inadvertently use non-genuine toner cartridges.

However, according to the first embodiment of the present invention, if the control unit 36 determines that the toner cartridges 13K, 13Y, 13M and 13C mounted to the main body 1 are genuine parts, the control unit 36 displays the corporation name information on the display unit 21. In contrast, if the control unit 36 determines that at least one of the toner cartridges 13K, 13Y, 13M and 13C mounted to the main body 1 is a non-genuine part, the control unit 36 does not display the corporation name information on the display unit 21. Therefore, the user can easily and immediately recognize whether the toner cartridges 13K, 13Y, 13M and 13C mounted to the main body 1 are genuine parts or not, by viewing the display unit 21.

Further, according to the first embodiment of the present invention, if the non-genuine toner cartridge is mounted to the main body 1, the printing-quality-maintenance operation (such as the image density correction operation) is not performed, and therefore there are cases where the printing quality may be lowered. In such cases, the user can realize that the printing quality is not assured when using the non-genuine toner cartridge. Accordingly, the user is discouraged from using the non-genuine toner cartridges, but is encouraged to use the genuine toner cartridges.

In the first embodiment, if the toner cartridge is a non-genuine part, the control unit 36 continues the printing operation without performing the printing-quality-maintenance operation such as the image density correction operation (see, the steps S1206 to S1208). However, it is also possible that the control unit 36 stops the printing operation immediately after the control unit 36 determines that the toner cartridge is a non-genuine part, or after the printing is performed on predetermined pages (for example, 100 pages) thereafter. This is advantageous when the user does not want to continuously use the non-genuine toner cartridge.

Second Embodiment

Figure 12:
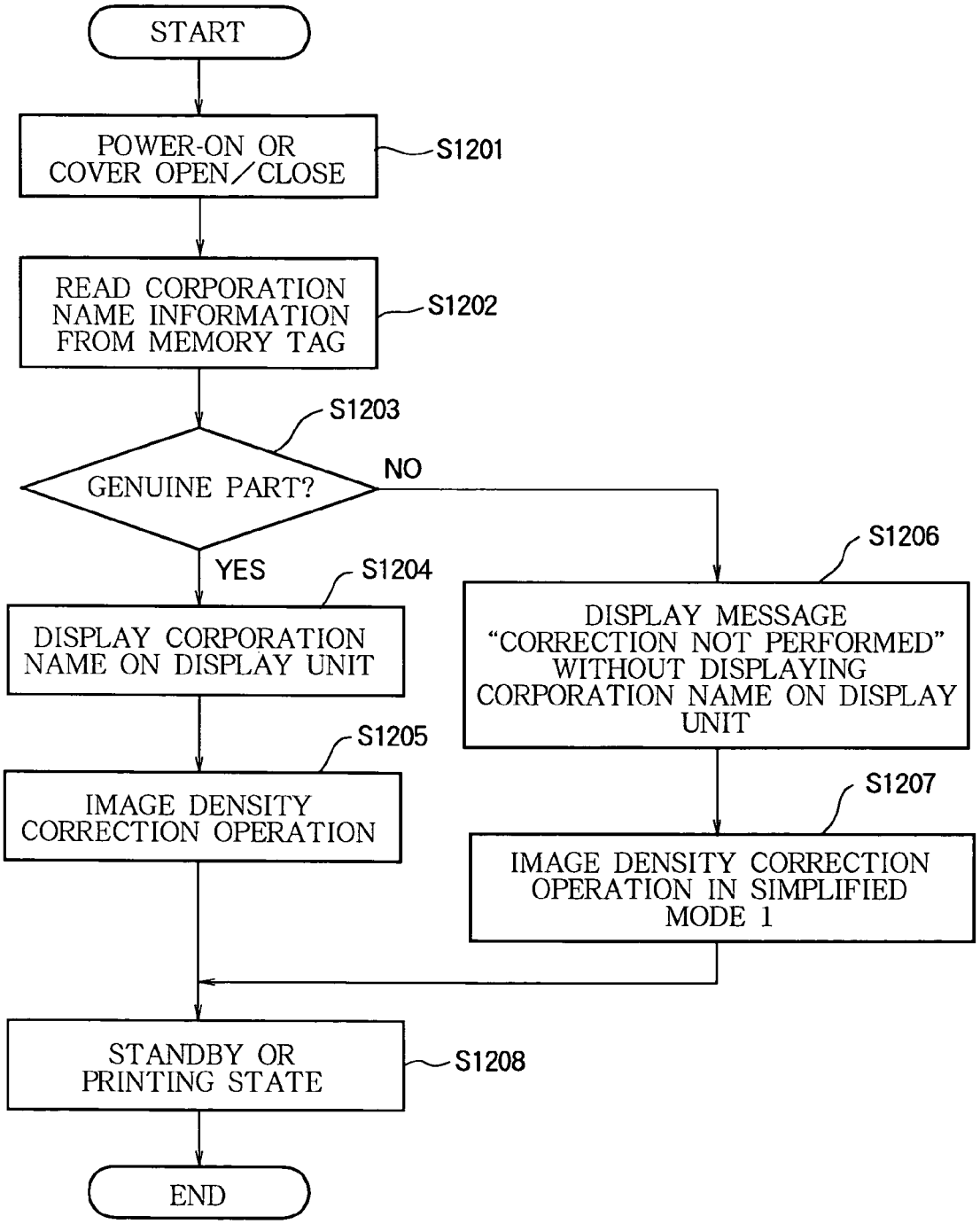
FIG. 12 is a flow chart showing a process according to the second embodiment of the present invention.

FIG. 12 is a flow chart showing a process according to the second embodiment of the present invention.

In the above described first embodiment, the control unit performs the printing-quality-maintenance operation (i.e., the image density correction operation) when the toner cartridges are genuine parts, but does not perform the printing-quality-maintenance operation when at least one of the toner cartridges is a non-genuine part. In contrast, in the second embodiment, the control unit performs the printing-quality-maintenance operation of a simplified mode (i.e., a simplified operation) when at least one of the toner cartridges is a non-genuine part.

In a step S1201, the control unit 36 detects the power-ON of the color printer 100 or the opening/closing of the top cover 2. In this regard, when the power of the color printer 100 is turned ON or when the top cover 2 is opened/closed, it indicates a possibility that the toner cartridge 13 is mounted to the main body 1 or the toner cartridge 13 is replaced.

In a step S1202, the control unit 36 controls the information reading unit 22 to perform RF communication with the memory tags 24K, 24Y, 24M and 24C of the toner cartridges 13K, 13Y, 13M and 13C, and to read predetermined information from the nonvolatile memories 35 of the memory tags 24K, 24Y, 24M and 24C. Each nonvolatile memory 35 stores the corporation name information (i.e., the name of the manufacturer of the toner cartridge 13) as the predetermined information.

In a step S1203, the control unit 36 determines whether the toner cartridges 13K, 13Y, 13M and 13C mounted to the main body 1 are genuine parts or not, based on the corporation name information read from the nonvolatile memories 35 of the memory tags 24K, 24Y, 24M and 24C (in the above described step S1202). If the control unit 36 determines that all of the toner cartridges 13K, 13Y, 13M and 13C mounted to the main body 1 are genuine parts (YES in the step S1203), the control unit 36 proceeds to a step S1204. If the control unit 36 determines that at least one of the toner cartridges 13K, 13Y, 13M and 13C mounted to the main body 1 is a genuine part (NO in the step S1203), the control unit 36 proceeds to a step S1206.

In the step S1204 (i.e., the toner cartridges 13K, 13Y, 13M and 13C are determined to be genuine parts in the step S1203), the control unit 36 displays the corporation name information on the display unit 21 as shown in FIG. 7. In this regard, the control unit 36 keeps displaying the corporation name information on the display unit 21 until the power-OFF of the color printer 100.

Then, in a step S1205, the control unit 36 performs the printing-quality-maintenance operation such as the image density correction operation (i.e., a normal mode) in order to prevent degradation of the printing quality due to time-depending changes or environmental changes as was describe in the first embodiment. This printing-quality-maintenance operation is performed, for example, after the power of the color printer 100 is turned ON or after the printing on the predetermined pages (for example, 500 pages) have been completed.

In the step S1206 (i.e., at least one of the toner cartridges 13K, 13Y, 13M and 13C is determined to be a non-genuine part in the step S1203), the control unit 36 does not display the corporation name information on the display unit 21, and sets the image density correction operation of a simplified mode 1, and proceeds to a step S1207. In the step S1207, the control unit 36 performs the image density correction operation of the simplified mode 1.

Figure 13:
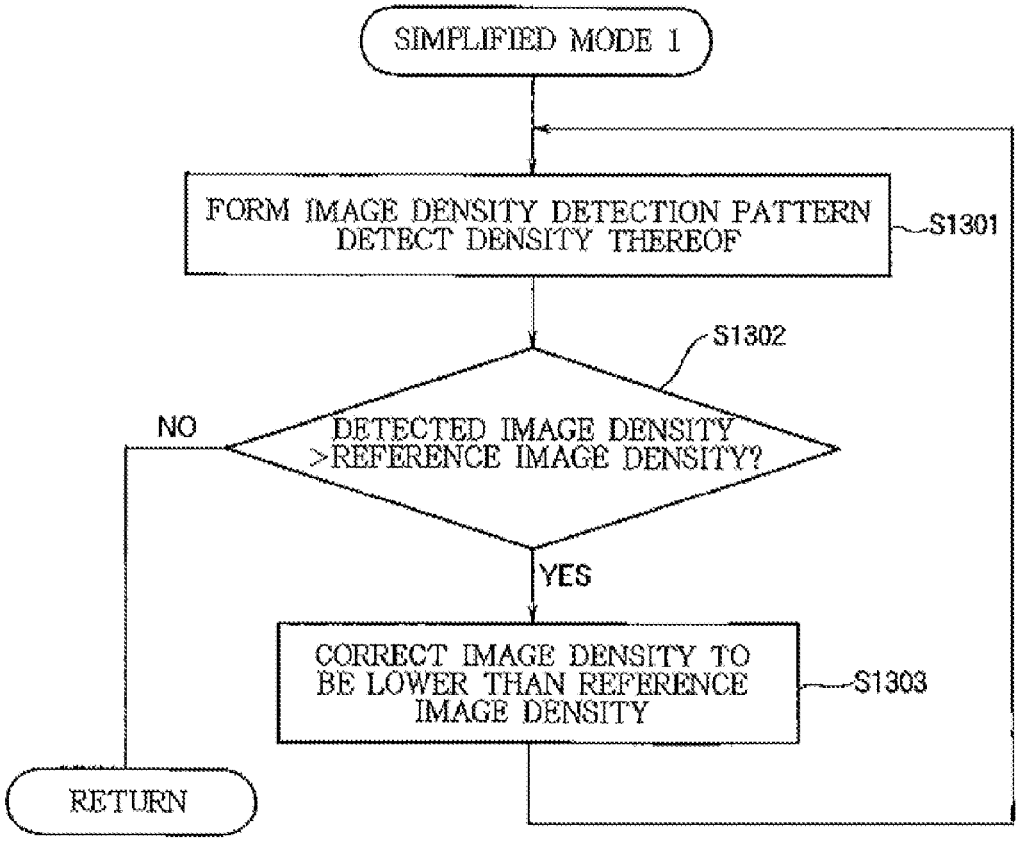
FIG. 13 is a flow chart showing an example of an image density correction operation of a simplified mode 1 according to the second embodiment of the present invention.

FIG. 13 is a flow chart showing an example of the image density correction operation of the simplified mode 1.

In a step S1301, the control unit 36 controls the color printer 100 so as to form the image density detection pattern 50 (FIG. 9) on the surface of the feeding belt 11 as was described in the first embodiment. Further, the control unit 36 performs the image density detection operation to detect the image density of the image density detection pattern 50 as was described in the first embodiment.

In a step S1302, the control unit 36 compares the image density detected by the detection sensor 19 and the reference image density on the reference image density line (FIG. 14) preliminarily stored in the control unit 36. If the detected image density is higher than the reference image density (YES in the step S1302), the control unit 36 proceeds to a step S1303. If the detected image density is lower than or equal to the reference image density (NO in the step S1302), the control unit 36 ends the image density correction operation of the simplified mode 1 without performing further correction operation, the reason of which will be described later.

Figure 14:
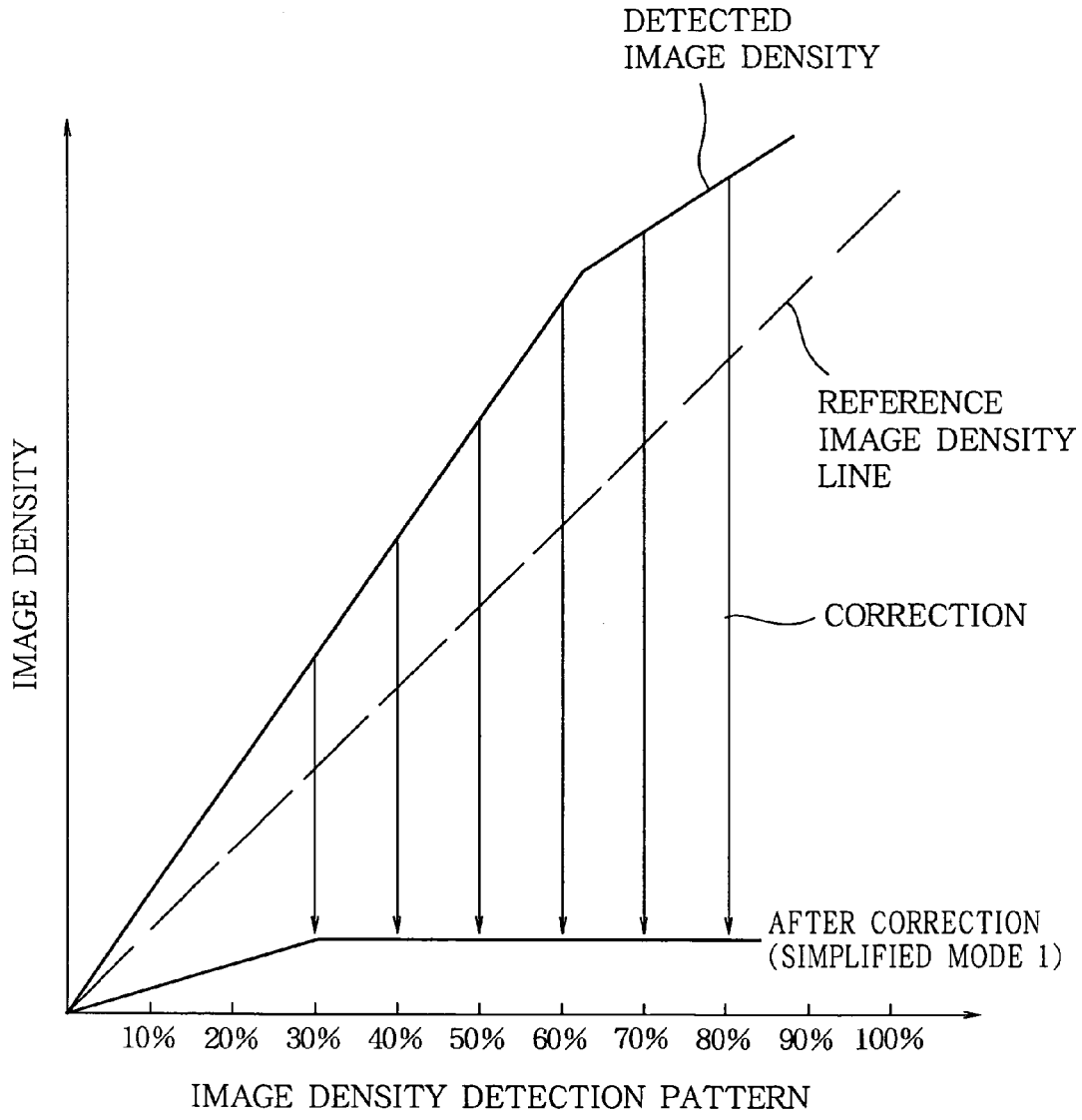
FIG. 14 is a schematic view schematically showing the image density correction operation of the simplified mode 1 according to the second embodiment of the present invention.

In the step S1303, the control unit 36 adjusts the developing voltage applied to the developing rollers 17K, 17Y, 17M and 17C and the light emission amount of the LED heads 12K, 12Y, 12M and 12C, so as to correct the image density. To be more specific, the control unit 36 performs the image density correction operation in a simple manner as shown in FIG. 14, so as to reduce the detected image density to be lower than the reference image density. For example, the control unit 36 reduces the light emission amount by reducing the exposure time of the LED heads 12K, 12Y, 12M and 12C. The steps S1301 to S1303 are repeated until the detected image density becomes lower than the reference image density.

Referring back to FIG. 12, in a step S1208, the color printer 100 is in a standby state (i.e., a state waiting for printing data) or in a printing state (i.e., a state having received the printing data).

Here, a description will be made of the reason why the control unit 36 ends the image density correction operation of the simplified mode 1 without performing further correction operation when the detected image density is lower than the reference image density.

In the image density correction operation, the density sensor 19 reads the image density detection pattern 50 formed on the surface of the feeding belt 11, and the control unit 36 adjusts the developing voltage applied to the developing rollers 17K, 17Y, 17M and 17C and the light emission amount of the LED heads 12K, 12Y, 12M and 12C so as to bring the image density of the image density detection pattern 50 (detected by the density sensor 19) closer to the reference image density line stored in the control unit 36. The reference image density line is preliminarily determined using a genuine toner. The developing voltage and the light emission amount are adjusted based on the detected image density of the image density detection pattern 50 formed using the toner stored in the toner cartridges 13K, 13Y, 13M and 13C mounted to the main body 1. Therefore, the image density correction operation is expected to have an effect if a genuine toner is used. However, the image density correction operation is not expected to have an effect if a non-genuine toner is used, since the reference image density line is not determined using the non-genuine toner. As an extreme example, if a non-genuine toner is used, there may be a case where the actual image density is high (i.e., dense) even when the detected image density is determined to be lower (i.e., thinner) than the reference image density. If the image density correction operation is performed in such a case, the actual image density may become further denser. This may cause a bleeding of the printed image, or may cause the recording medium P to be wound around the heat roller 16A of the fixing unit 16 via molten toner when a high duty image is printed on the recording medium P. The fixing unit 16 has the heater (such as a halogen lamp) whose temperature is controlled, and therefore the winding of the recording medium P may cause a failure of the color printer 100.

For these reasons, the control unit 36 does not perform the image density correction operation if the control unit 36 determines that at least one of the toner cartridges 13K, 13Y, 13M and 13C is a non-genuine part and if the image density detected by the density sensor 19 is lower than the reference image density. In contrast, if the image density detected by the density sensor 19 is higher than the reference image density, the control unit 36 performs the image density correction operation of the simplified mode 1 so as to reduce the image density to be lower than the reference image density. In this regard, it is also possible to reduce the image density largely to a substantially uniform density, i.e., a lower limit of a predetermined image correction operation range as shown in FIG. 14.

As described above, according to the second embodiment of the present invention, if the non-genuine toner cartridge is used, and if the detected image density is higher than the reference image density, the control unit 36 reduces the image density to a level lower than the reference image density in a simple manner. Therefore, in addition to the advantages of the first embodiment, it becomes possible to prevent the image bleeding and the failure of the color printer 100 and the like due to excessively high image density.

Third Embodiment

Figure 15:
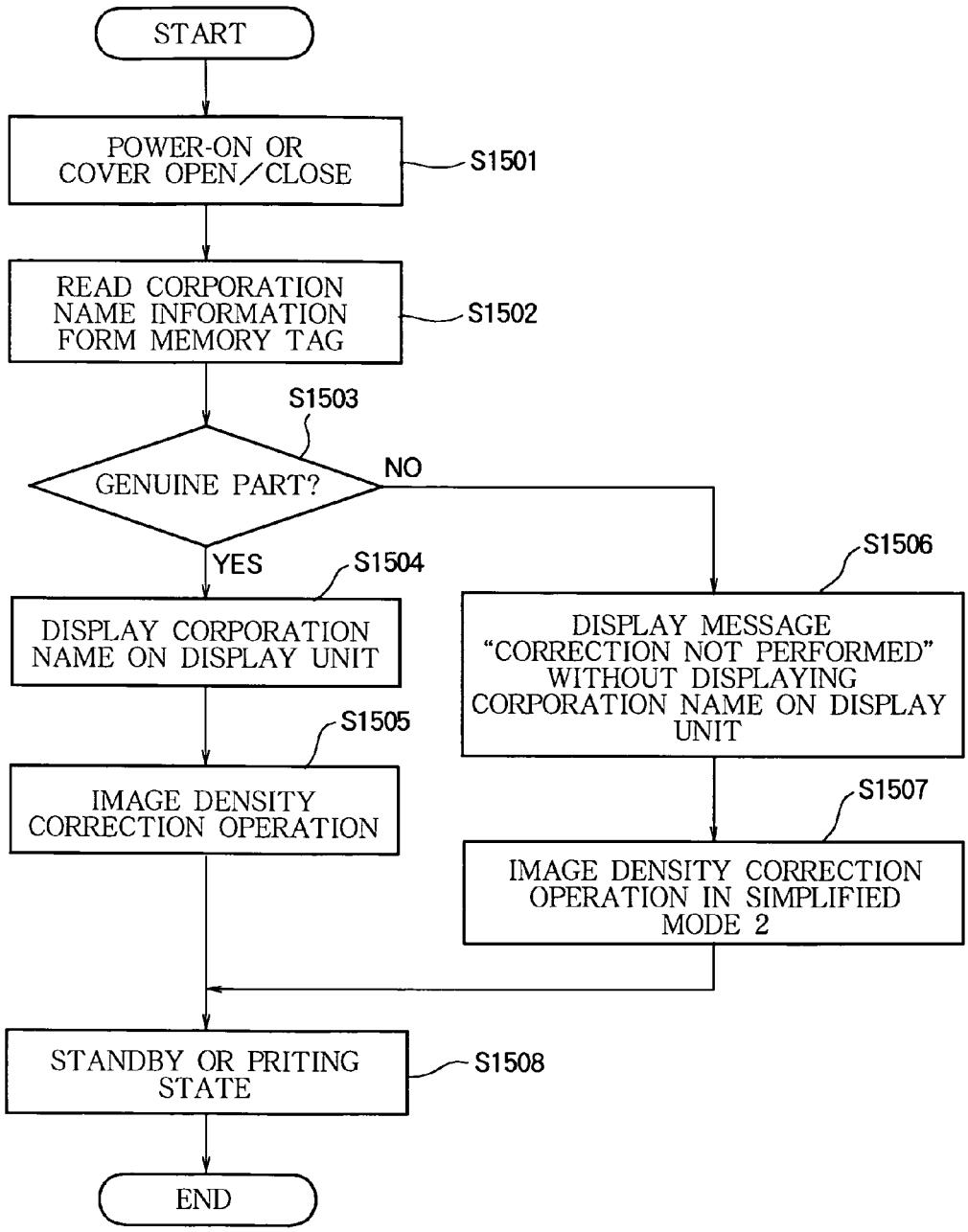
FIG. 15 is a flow chart showing a process according to the third embodiment of the present invention.

FIG. 15 is a flow chart showing a process according to the third embodiment of the present invention.

In the above described second embodiment, if the toner cartridge is determined to be a non-genuine part, the image density correction operation of the simplified mode 1 is performed. In contrast, in the third embodiment, if the toner cartridge is determined to be a non-genuine part, the image density correction operation of the simplified mode 2, which is different from the simplified mode 1, is performed.

In a step S1501, the control unit 36 detects the power-ON of the color printer 100 or the opening/closing of the top cover 2. In this regard, when the power of the color printer 100 is turned ON or when the top cover 2 is opened/closed, it indicates a possibility that the toner cartridge 13 is mounted to the main body 1 or the toner cartridge 13 is replaced.

In a step S1502, the control unit 36 controls the information reading unit 22 to perform RF communication with the memory tags 24K, 24Y, 24M and 24C of the toner cartridges 13K, 13Y, 13M and 13C, and to read predetermined information from the nonvolatile memories 35 of the memory tags 24K, 24Y, 24M and 24C. Each nonvolatile memory 35 stores the corporation name information (i.e., the name of the manufacturer of the toner cartridge) as the predetermined information.

In a step S1503, the control unit 36 determines whether the toner cartridges 13K, 13Y, 13M and 13C mounted to the main body 1 are genuine parts or not, based on the corporation name information read from the nonvolatile memories 35 of the memory tags 24K, 24Y, 24M and 24C (in the above described step S1502). If the control unit 36 determines that all of the toner cartridges 13K, 13Y, 13M and 13C mounted to the main body 1 are genuine parts (YES in the step S1503), the control unit 36 proceeds to a step S1504. If the control unit 36 determines that at least one of the toner cartridges 13K, 13Y, 13M and 13C mounted to the main body 1 is a genuine part (NO in the step S1503), the control unit 36 proceeds to a step S1506.

In the step S1504 (i.e., the toner cartridges 13K, 13Y, 13M and 13C are determined to be genuine parts in the step S1503), the control unit 36 displays the corporation name information on the display unit 21 as shown in FIG. 7. In this regard, the control unit 36 keeps displaying the corporation name information on the display unit 21 until the power-OFF of the color printer 100.

Then, in a step S1505, the control unit 36 performs the printing-quality-maintenance operation such as the image density correction operation (i.e., a normal mode) in order to prevent degradation of the printing quality due to time-depending changes or environmental changes as was described in the first embodiment. This printing-quality-maintenance operation is performed, for example, after the power of the color printer 100 is turned ON or after the printing on the predetermined pages (for example, 500 pages) have been completed.

In the step S1506 (i.e., at least one of the toner cartridges 13K, 13Y, 13M and 13C is determined to be a non-genuine part in the step S1503), the control unit 36 does not display the corporation name information on the display unit 21, and sets the image density correction operation of a simplified mode 2, and proceeds to a step S1507. In the step S1507, the control unit 36 performs the image density correction operation of the simplified mode 2.

Figure 17:
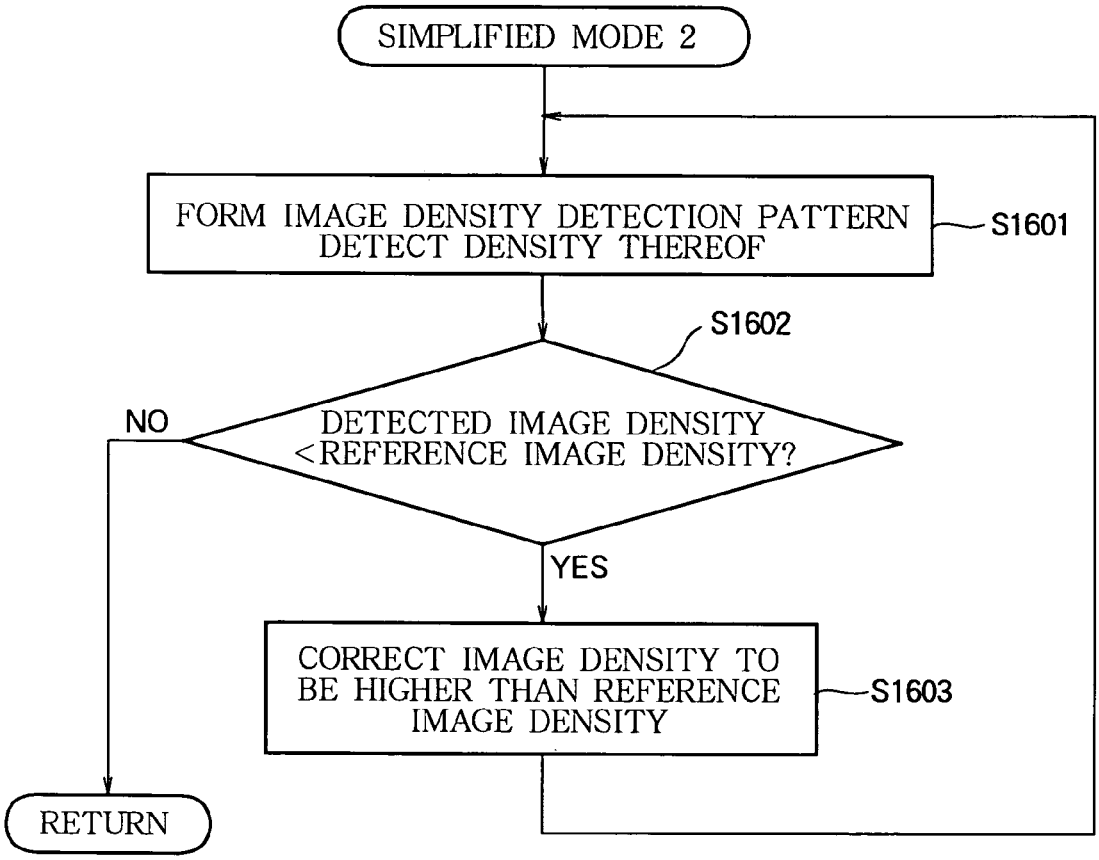
FIG. 17 is a schematic view schematically showing the image density correction operation of the simplified mode 2 according to the third embodiment of the present invention.

FIG. 17 is a flow chart showing an example of the image density correction operation of the simplified mode 2.

In a step S1601, the control unit 36 controls the color printer 100 so as to form the image density detection pattern 50 (FIG. 9) on the surface of the feeding belt 11 as was described in the first embodiment. Then, the control unit 36 performs the image density detection operation to detect the image density of the image density detection pattern 50 as was described in the first embodiment.

Figure 16:
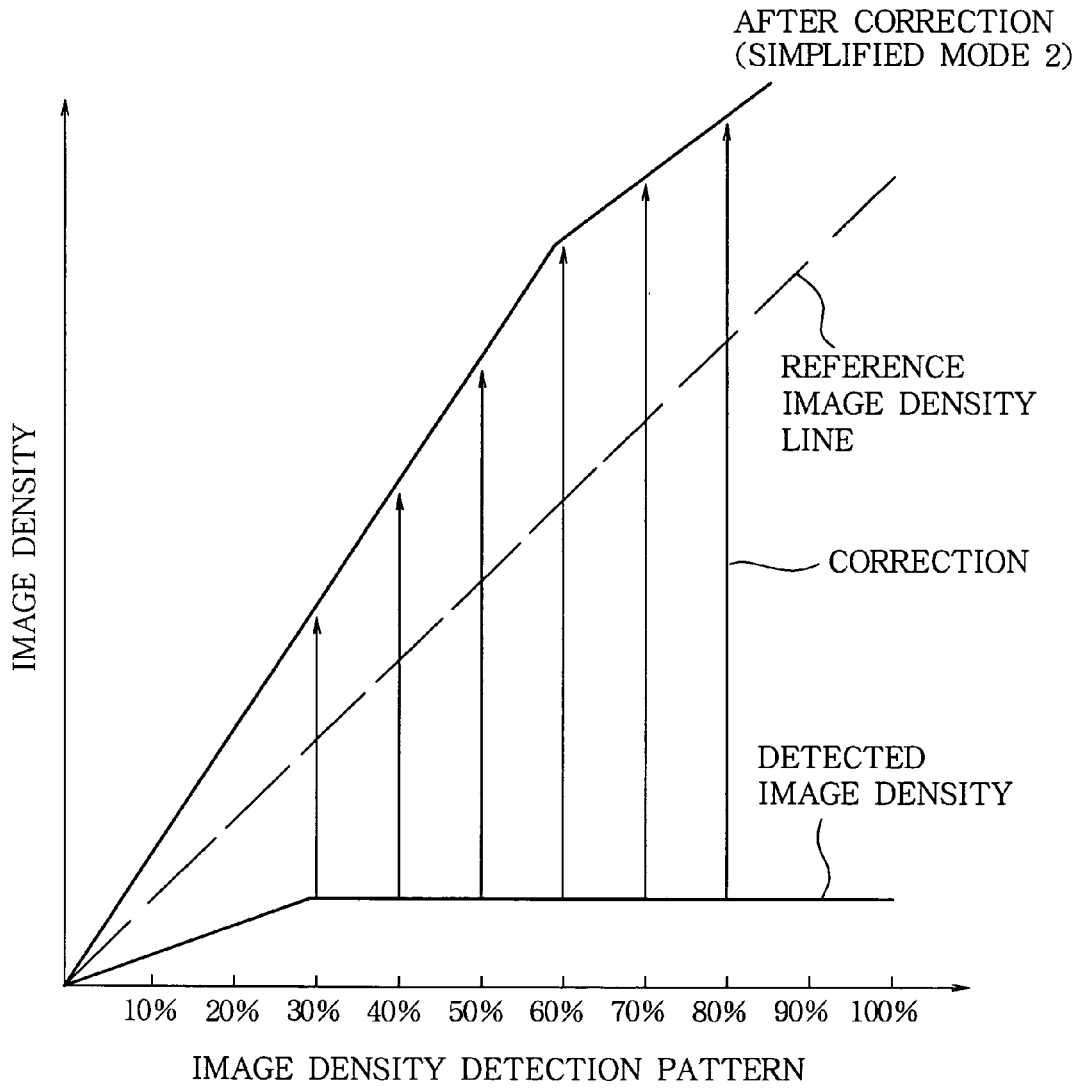
FIG. 16 is a flow chart showing an example of an image density correction operation of a simplified mode 2 according to the third embodiment of the present invention.

In a step S1602, the control unit 36 compares the image density detected by the detection sensor 19 and the reference image density on the reference image density line (FIG. 16) preliminarily stored in the control unit 36. If the detected image density is lower than the reference image density (YES in the step S1602), the control unit 36 proceeds to a step S1603. If the detected image density is higher than or equal to the reference image density (NO in the step S1602), the control unit 36 ends the image density correction operation of the simplified mode 2 without performing further correction, the reason of which will be described later.

In the step S1603, the control unit 36 adjusts the developing voltage applied to the developing rollers 17K, 17Y, 17M and 17C and the light emission amount of the LED heads 12K, 12Y, 12M and 12C, so as to correct the image density. To be more specific, the control unit 36 performs the image density correction operation in a simple manner as shown in FIG. 17, so as to increase the detected image density to be higher than the reference image density. For example, the control unit 36 increases the light emission amount by increasing the exposure time of the LED heads 12K, 12Y, 12M and 12C. The steps S1601 to S1603 are repeated until the image density becomes higher than the reference image density.

Referring back to FIG. 15, in a step S1508, the color printer 100 is in a standby state (i.e., a state waiting for the printing data) or in a printing state (i.e., a state having received the printing data).

As described above, according to the third embodiment of the present invention, if the non-genuine toner cartridge is used, and if the detected image density is lower than the reference image density, the control unit 36 increases the image density to a level higher than the reference image density in a simple manner. Therefore, in addition to advantages of the first embodiment, it becomes possible to prevent the image blurring (fading) or the like due to excessively low image density.

In the above described embodiments, the corporation name information of the toner cartridge is used to determine whether the toner cartridge is a genuine part or not. However, it is also possible to use a product name or a trademark of the toner cartridge instead of the corporation name.

Further, in the above described embodiments, the image density correction operation (by means of the density sensor 19) is performed an example of the printing-quality-maintenance operation. However, it is also possible to perform a color shift correction operation by means of a color shift sensor as another example of the printing-quality-maintenance operation. It is also possible to perform both of the image density correction operation and the color shift correction operation. In this regard, the color shift correction operation can be performed by forming a special pattern (for the color shift correction) on the surface of the feeding belt 11 using the toner, and by detecting a reflectance of the special pattern using an optical sensor (i.e., the color shift sensor). As is the case with the image density correction operation, the color shift correction operation is not expected to have an effect when a non-genuine toner is used.

In the above described embodiments, the control unit 36 detects whether the toner cartridges 13K, 13Y, 13M and 13C mounted to the main body 1 are all genuine parts, and determines the operation based on the detection result. However, the control unit 36 can also have a function to determine the operation based on the number of non-genuine toner cartridge (s) among the toner cartridges 13K, 13Y, 13M and 13C mounted to the main body 1. Moreover, the control unit 36 can also have a function to detect which color of the toner cartridges 13K, 13Y, 13M and 13C is a non-genuine part, and determine the operation based on the detected result.

Moreover, in the above described embodiments, the tandem-type color printer 100 has been described as an image forming apparatus. However, the present invention is not limited to the tandem-type color printer, but is applicable to a copier, a facsimile, multifunction peripheral (MFP) or the like having an image forming function. Further, the present invention is not limited to the color image forming apparatus, but is applicable to a monochrome image forming apparatus.

While the preferred embodiments of the present invention have been illustrated in detail, it should be apparent that modifications and improvements may be made to the invention without departing from the spirit and scope of the invention as described in the following claims.

What is claimed is:

1. An image forming apparatus capable of performing a plurality of controlling operations, said image forming apparatus comprising:

a detachable replaceable part having an information storing unit that stores first information;

an information reading unit that reads said first information from said information storing unit;

a comparison unit that compares said first information read by said information reading unit and second information;

a determining unit that determines whether said replaceable part is a genuine part or not, based on a comparison result provided by said comparison unit; and a control unit that determines a controlling operation among said plurality of controlling operations based on a determination by the determining unit;

wherein when said determining unit determines that said replaceable part is a genuine part, said control unit performs an operation that maintains printing quality, and said control unit performs a printing operation; and wherein when said determining unit determines that said replaceable part is not a genuine part, said control unit does not perform said operation that maintains printing quality.

2. The image forming apparatus according to claim 1, wherein said first information includes a name of a manufacturer.

3. The image forming apparatus according to claim 1, wherein said first information includes a trademark.

4. The image forming apparatus according to claim 1, wherein said first information includes a product name.

5. The image forming apparatus according to claim 1, wherein said operation for maintaining printing quality is an image density correction operation.

6. The image forming apparatus according to claim 5, wherein, in said image density correction operation, said control unit controls said image forming apparatus to form an image density detection pattern, detects an image density of said image density detection pattern, compares said image density with a reference image density, and adjusts settings of said image forming apparatus to bring said image density to be closer to said reference image density.

7. The image forming apparatus according to claim 1, wherein said operation for maintaining printing quality is a color shift correction operation.

8. The image forming apparatus according to claim 1, wherein said replaceable part is a developer storing body.

9. The image forming apparatus according to claim 8, further comprising a main body including an image forming unit that forms an image using a developer, wherein said developer storing body is detachably mounted to said main body.

10. The image forming apparatus according to claim 8, wherein said information storing unit is a memory tag mounted to said developer storing body.

11. The image forming apparatus according to claim 1, wherein said information reading unit includes a receiving antenna with which said information reading unit reads said first information from said information storing unit.

12. The image forming apparatus according to claim 1, wherein when said determining unit determines that said replaceable part is not a genuine part, said control unit performs said printing operation without performing said operation for maintaining printing quality.

13. The image forming apparatus according to claim 1, wherein when said determining unit determines that said replaceable part is not a genuine part, said control unit performs neither said operation for maintaining printing quality nor said printing operation.

14. The image forming apparatus according to claim 1, wherein when said determining unit determines that said replaceable part is not a genuine part, said control unit performs said printing operation on a predetermined number of media without performing said operation for maintaining printing quality and then stops said printing operation.

15. The image forming apparatus according to claim 1, further comprising a display unit capable of displaying said first information.

16. The image forming apparatus according to claim 15, wherein said controlling unit controls said display unit so as to display said first information when said determining unit determines that said replaceable part is a genuine part.

17. The image forming apparatus according to claim 16, further comprising a power source for supplying electricity to said image forming apparatus, wherein said controlling unit causes said display unit to keep displaying said first information until said power source is turned off.

18. The image forming apparatus according to claim 15, wherein said controlling unit controls said display unit so as not to display said first information when said determining unit determines that said replaceable part is not a genuine part.

19. An image forming apparatus capable of performing a plurality of controlling operations, said image forming apparatus comprising:

a detachable replaceable part having an information storing unit that stores first information;

an information reading unit that reads said first information from said information storing unit;

a comparison unit that compares said first information read by said information reading unit and second information;

a determining unit that determines whether said replaceable part is a genuine part or not, based on a comparison result provided by said comparison unit; and a control unit that determines a controlling operation among said plurality of controlling operations based on a determination by the determining unit, wherein when said determining unit determines that said replaceable part is a genuine part, said control unit performs a first image density correction operation and a printing operation;

wherein in said first image density correction operation, said control unit forms an image density detection pattern, detects an image density of said image density detection pattern, compares said image density and a reference image density, and adjusts settings of said image forming apparatus to bring said image density to be closer to said reference image density;

wherein when said determining unit determines that said replaceable part is not a genuine part, said control unit performs a second image density correction operation and a printing operation; and wherein in said second image density correction operation, said control unit adjusts settings of said image forming apparatus to reduce said image density to be lower than said reference image density when said image density is higher than said reference image density, or said control unit adjusts settings of said image forming apparatus to increase said image density to be higher than said reference image density when said image density is lower than said reference image density.

20. The image forming apparatus according to claim 19, further comprising a display unit capable of displaying said first information.

21. The image forming apparatus according to claim 20, wherein when said determining unit determines that said replaceable part is a genuine part, said control unit causes said display unit to display said first information.

22. The image forming apparatus according to claim 20, wherein when said determining unit determines that said replaceable part is not a genuine part, said control unit causes said display unit not to display said first information.

23. The image forming apparatus according to claim 19, wherein said first information includes a name of a manufacturer.

24. The image forming apparatus according to claim 19, wherein said replaceable part is a developer storing body.

25. The image forming apparatus according to claim 24, wherein said information storing unit is a memory tag mounted to said developer storing body.

26. The image forming apparatus according to claim 19, wherein said information reading unit includes a receiving antenna with which said information reading unit reads said first information from said information storing unit.

* * * * *